US009346279B2

(12) United States Patent
Otobe

(10) Patent No.: US 9,346,279 B2
(45) Date of Patent: May 24, 2016

(54) LIQUID CARTRIDGE AND LIQUID EJECTING APPARATUS

(71) Applicant: BROTHER KOGYO KABUSHIKI KAISHA, Nagoya-shi, Aichi-ken (JP)

(72) Inventor: Mutsumi Otobe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/856,687

(22) Filed: Sep. 17, 2015

(65) Prior Publication Data

US 2016/0001564 A1 Jan. 7, 2016

Related U.S. Application Data

(63) Continuation of application No. 14/166,263, filed on Jan. 28, 2014, now Pat. No. 9,144,989, which is a continuation-in-part of application No. PCT/JP2011/067255, filed on Jul. 28, 2011.

(51) Int. Cl.
*B41J 2/175* (2006.01)

(52) U.S. Cl.
CPC ..... *B41J 2/17546* (2013.01)

(58) Field of Classification Search
CPC .... B41J 2/175; B41J 2/17503; B41J 2/17506; B41J 2/17509; B41J 2/17543; B41J 2/17546; B41J 2/1752; B41J 2/1755
USPC ..... 347/86
See application file for complete search history.

(56) References Cited

U.S. PATENT DOCUMENTS 6,113,229 A 9/2000 Gunther et al.
6,378,971 B1 * 4/2002 Tamura ..... B41J 2/175 347/7
2007/0268347 A1 11/2007 Amano et al.
(Continued)

FOREIGN PATENT DOCUMENTS

EP 0 826 505 A2 3/1998
EP 1285764 A1 2/2003
(Continued)

OTHER PUBLICATIONS

International Search Report and Written Opinion issued in PCT/JP2011/067255, mailed Aug. 22, 2011.
(Continued)

*Primary Examiner* — Geoffrey Mruk
*Assistant Examiner* — Scott A Richmond
(74) *Attorney, Agent, or Firm* — Merchant & Gould P.C.

(57) ABSTRACT

In a liquid cartridge, a liquid storing section defines a liquid storing chamber storing liquid, and a channel section defines a channel in fluid communication with the liquid storing chamber. A field forming section forms a field that changes depending on a position of a movable member that is movable in the channel. A power-source potential is inputted to a power-source terminal, and a ground potential is inputted to a ground terminal. A sensor is electrically connected with the power-source terminal and the ground terminal, and generates a potential based on the position of the movable member by being disposed in the field formed by the field forming section. An output terminal outputs the potential generated by the sensor. The sensor generates the potential higher than a ground potential regardless of the position of the movable member.

4 Claims, 23 Drawing Sheets

(56) References Cited

U.S. PATENT DOCUMENTS

| | | | |
|---|---|---|---|
| 2008/0231676 | A1 | 9/2008 | Shimizu |
| 2009/0322838 | A1 | 12/2009 | Wanibe et al. |
| 2010/0091070 | A1 | 4/2010 | Kimura |
| 2010/0110154 | A1 | 5/2010 | Iwamura et al. |
| 2010/0220127 | A1 | 9/2010 | Levy et al. |
| 2010/0289847 | A1 | 11/2010 | Ishizawa et al. |

FOREIGN PATENT DOCUMENTS

| | | | |
|---|---|---|---|
| EP | 2 202 078 | A1 | 6/2010 |
| JP | 61-158460 | A | 7/1986 |
| JP | 8-80618 | A | 3/1996 |
| JP | 11-286123 | A | 10/1999 |
| JP | 2000-225692 | A | 8/2000 |
| JP | 2010-208288 | A | 9/2010 |
| JP | 2010-240979 | A | 10/2010 |

OTHER PUBLICATIONS

Extended European Search Report issued in the counterpart European application EP11870059.0, mailed Apr. 1, 2015.

* cited by examiner

LIQUID CARTRIDGE AND LIQUID EJECTING APPARATUS

CROSS REFERENCE TO RELATED APPLICATIONS

This is a continuation of U.S. patent application Ser. No. 14/166,263, filed Jan. 28, 2014, which is a Continuation-In-Part Application of International Application No. PCT/JP2011/067255 filed Jul. 28, 2011. The entire disclosure of both prior applications is hereby incorporated by reference in their entirety.

TECHNICAL FIELD

The invention relates to a liquid cartridge that stores liquid and to a liquid ejecting apparatus including a liquid cartridge and an apparatus main body on which the liquid cartridge is mounted.

BACKGROUND

According to known technology, an ink remaining-amount sensor is provided at a liquid cartridge mounted on a liquid ejecting apparatus. Further, a cartridge-mounting detection sensor is provided at a liquid cartridge mounted on a liquid ejecting apparatus.

SUMMARY

The inventor of the present application conceived providing, at a liquid cartridge, a plurality of sensors such as the ink remaining-amount sensor, the cartridge-mounting detection sensor, etc. disclosed in the above-mentioned technology.

However, providing a plurality of sensors at the liquid cartridge leads to a cost increase of the liquid cartridge.

In view of the foregoing, the invention provides a liquid cartridge including: a liquid storing section defining a liquid storing chamber that stores liquid; a channel section defining a channel in fluid communication with the liquid storing chamber; a field forming section including a movable member that is movable in the channel and configured to form a field that changes depending on a position of the movable member; a power-source terminal configured such that a power-source potential is inputted thereto; a ground terminal configured such that a ground potential is inputted thereto; a sensor electrically connected with the power-source terminal and the ground terminal, the sensor being configured to generate a potential based on the position of the movable member by being disposed in the field formed by the field forming section; and an output terminal electrically connected with the sensor and configured to output the potential generated by the sensor. The sensor is configured to generate a potential higher than the ground potential regardless of the position of the movable member.

According to another aspect, the invention also provides a liquid ejecting apparatus including a liquid cartridge and an apparatus main body on which the liquid cartridge can be mounted. The liquid cartridge includes: a liquid storing section defining a liquid storing chamber that stores liquid; a channel section defining a channel in fluid communication with the liquid storing chamber; a field forming section including a movable member that is movable in the channel and configured to form a field that changes depending on a position of the movable member; a power-source terminal configured such that a power-source potential is inputted thereto; a ground terminal configured such that a ground potential is inputted thereto; a sensor electrically connected with the power-source terminal and the ground terminal, the sensor being configured to generate a potential based on the position of the movable member by being disposed in the field formed by the field forming section; and an output terminal electrically connected with the sensor and configured to output the potential generated by the sensor. The apparatus main body includes: a mounting section on which the liquid cartridge is mounted; a hollow member configured to be inserted in the channel of the liquid cartridge mounted on the mounting section; a liquid ejecting head in fluid communication with the hollow member and configured to eject liquid supplied from the liquid cartridge through the hollow member; a power-source potential inputting section configured to input the power-source potential to the power-source terminal; a ground potential inputting section configured to input the ground potential to the ground terminal; a sensor-signal receiving section configured to, when the liquid cartridge is mounted on the mounting section, be connected with the output terminal and receive the potential generated by the sensor; a mount determining section configured to determine whether the liquid cartridge is mounted on the mounting section, based on the potential received by the sensor-signal receiving section; and a position determining section configured to determine the position of the movable member, based on the potential received by the sensor-signal receiving section. The sensor-signal receiving section is configured to receive a predetermined potential when the liquid cartridge is not mounted on the mounting section, and to receive a potential different from the predetermined potential regardless of the position of the movable member when the liquid cartridge is mounted on the mounting section. The mount determining section is configured to determine that the liquid cartridge is not mounted on the mounting section when the potential received by the sensor-signal receiving section is in a first range including the predetermined potential, and to determine that the liquid cartridge is mounted on the mounting section when the potential received by the sensor-signal receiving section is in a second range different from the first range.

BRIEF DESCRIPTION OF THE DRAWINGS

Embodiments in accordance with the invention will be described in detail with reference to the following figures wherein:

FIGS. 5A and 5B are partial cross-sectional views of a region V shown in FIG. 4, wherein FIG. 5A shows a state in which a hollow needle of the printer is not inserted in a plug and a valve is in a closed position, and FIG. 5B shows a state in which the hollow needle of the printer is inserted in the plug and the valve is in an open position;

FIGS. 8A through 8C are schematic plan views showing a process in which the cartridge is mounted onto the printer, wherein FIG. 8A shows a state before the cartridge is mounted onto the printer, FIG. 8B shows a state in which the cartridge is inserted to a position where the terminal of the cartridge contacts a terminal of the printer, and FIG. 8C shows a state in which a hollow needle supported by a support body has moved in a direction of a filled arrow and penetrated the plug of the cartridge;

FIGS. 19A and 19B are partial cross-sectional views showing a cartridge according to a fourth embodiment of the invention, wherein FIG. 19A shows a state in which a hollow needle of a printer is not inserted into a plug, and FIG. 19B shows a state in which the hollow needle of the printer is inserted into the plug;

FIGS. 22A and 22B are partial cross-sectional views of the ink cartridge according to the fifth embodiment, wherein FIG. 22A shows a state in which two valves are in a closed state, and FIG. 22B shows a state in which the two valves are in an open state.

DETAILED DESCRIPTION

Figure 1:
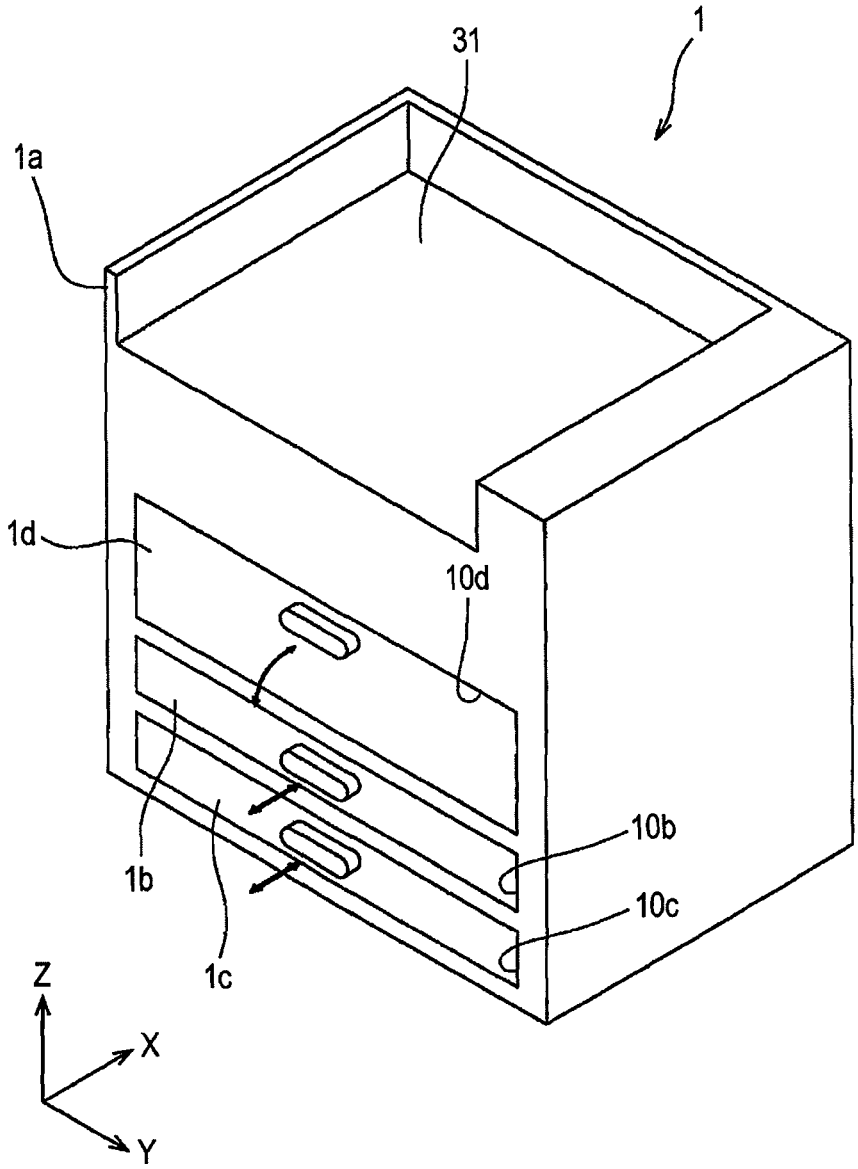
FIG. 1 is a perspective view showing the exterior of an inkjet printer according to a first embodiment of the invention.

Hereinafter, embodiments of the invention will be described while referring to the accompanying drawings. First, the overall configuration of an inkjet-type printer 1 according to a first embodiment of a liquid ejecting apparatus of the invention will be described while referring to FIG. 1.

The printer 1 has a housing 1*a* having a rectangular parallelepiped shape. A paper discharging section 31 is provided on a top plate of the housing 1*a*. Three openings 10*d*, 10*b*, and 10C are provided on a front surface (the surface on the near left side in the drawing of FIG. 1) of the housing 1*a* in this order from the top. The opening 10*b* is for inserting a paper supplying unit 1*b* inside the housing 1*a*. The opening 10*c* is for inserting a cartridge unit 1*c* inside the housing 1*a*. The opening 10*d* is fitted with a door 1*d* that can open and close pivotally about a horizontal axis on its lower end. The door 1*d* is disposed in confrontation with a conveying unit 21 (see FIG. 2) in a main scanning direction X (the direction perpendicular to the front surface of the housing 1*a*) of the housing 1*a*.

Next, the internal structure of the printer 1 will be described with reference to FIG. 2.

The internal space of the housing 1*a* can be divided into spaces A, B, and C in this order from the top. In the space A, two heads 2, the conveying unit 21, and a controller 100 are disposed. The two heads 2 eject black ink and pre-coat liquid (hereinafter, these may be collectively referred to as "liquid"), respectively. The conveying unit 21 conveys paper P. The controller 100 controls operations of each section of the printer 1. In the spaces B and C, the paper supplying unit 1*b* and the cartridge unit 1*c* are disposed, respectively. Within the printer 1, a paper conveying path along which paper P is conveyed is formed from the paper supplying unit 1*b* to a paper discharging section 31 along thick arrows in FIG. 2.

The controller 100 includes a CPU (Central Processing Unit) which is an arithmetic processing unit, a ROM (Read Only Memory), a RAM (Random Access Memory: including non-volatile RAM), I/F (Interface), and the like. The ROM stores programs executed by the CPU, various constant data, and the like. The RAM can temporarily store data (image data etc.) that are required when the programs are executed. The controller 100 performs data transmission and reception with a memory 141 and Hall elements 71 of a cartridge 40, data transmission and reception with an external device (a personal computer connected with the printer 1 etc.), and the like, via the I/F.

The paper supplying unit 1*b* includes a paper supplying tray 23 and a paper supplying roller 25. Of these, the paper supplying tray 23 is detachable from the housing 1*a* in the main scanning direction X. The paper supplying tray 23 is a box which is opened upward, and can accommodate paper P in a plurality of sizes. The paper supplying roller 25 rotates by driving of a paper supplying motor 125 (see FIG. 9A) under controls by the controller 100, and picks up paper P at the topmost position in the paper supplying tray 23. The paper P picked up by the paper supplying roller 25 is sent to the conveying unit 21 while being guided by guides 27*a* and 27*b* and being nippingly held by a pair of feed rollers 26.

The conveying unit 21 includes two belt rollers 6 and 7, an endless-type conveying belt 8 looped around the both rollers 6 and 7. The belt roller 7 is a drive roller and, under controls by the controller 100, rotates in the clockwise direction in FIG. 2 by driving of a conveying motor 127 (see FIG. 9A) connected with its shaft. The belt roller 6 is a follow roller, and rotates in the clockwise direction in FIG. 2 by following the movement of the conveying belt 8 caused by rotation of the belt roller 7.

A platen 19 having a rectangular parallelepiped shape is disposed within the loop of the conveying belt 8 so as to confront the two heads 2. The upper loop of the conveying belt 8 is supported by the platen 19 from the inner peripheral surface side, so that an outer peripheral surface 8*a* of the conveying belt 8 extends parallel to lower surfaces 2*a* (ejecting surfaces in which a large number of ejection ports for ejecting liquid is formed) of the two heads 2 with a predetermined gap therebetween.

A silicone layer with slight adherence is formed on the outer peripheral surface 8*a* of the conveying belt 8. The paper P sent from the paper supplying unit 1*b* to the conveying unit 21 is pressed against the outer peripheral surface 8*a* of the conveying belt 8 by a pressing roller 4, and is subsequently conveyed in a sub-scanning direction Y along the thick arrows while being held on the outer peripheral surface 8*a* by adhesive force.

Here, the sub-scanning direction Y is a direction parallel to the conveying direction of paper P by the conveying unit 21. The main scanning direction X is a direction perpendicular to the sub-scanning direction Y and parallel to a horizontal surface. Each of the main scanning direction X and the sub-scanning direction Y is perpendicular to a vertical direction Z.

When the paper P passes a position directly below each head 2, the heads 2 are driven under controls by the controller 100 so that liquid (black ink, and pre-coat liquid depending on situations) is ejected toward the top surface of the paper P from the lower surface 2*a* of each head 2, thereby recording a desired image on the paper P. Then, the paper P is separated from the outer peripheral surface 8*a* of the conveying belt 8 by a separation plate 5, is conveyed upward while being guided by guides 29*a* and 29*b* and being nippingly held by two pairs of rollers 28, and is discharged onto the paper discharging section 31 through an opening 30 formed at an upper section of the housing 1*a*. One roller of each pair of rollers 28 rotates by driving of a feed motor 128 (see FIG. 9A) under controls by the controller 100.

The pre-coat liquid is liquid having, for example, an effect of improving density (an effect of improving density of ink ejected on paper P), an effect of preventing running of ink and permeation of ink (a phenomenon that ink ejected on the top surface of paper P penetrates the layer of paper P and runs on the bottom surface), an effect of improving chromogenic characteristics and quick drying characteristics, an effect of suppressing wrinkles and curl of paper P subsequent to ejection of ink, and the like. As the pre-coat liquid, for example, liquid containing multivalent metal salt such as cationic polymer, magnesium salt, etc. may be used.

The head 2 that ejects pre-coat liquid is disposed at an upstream side of the head 2 that ejects black ink with respect to the conveying direction of paper P.

Figure 2:
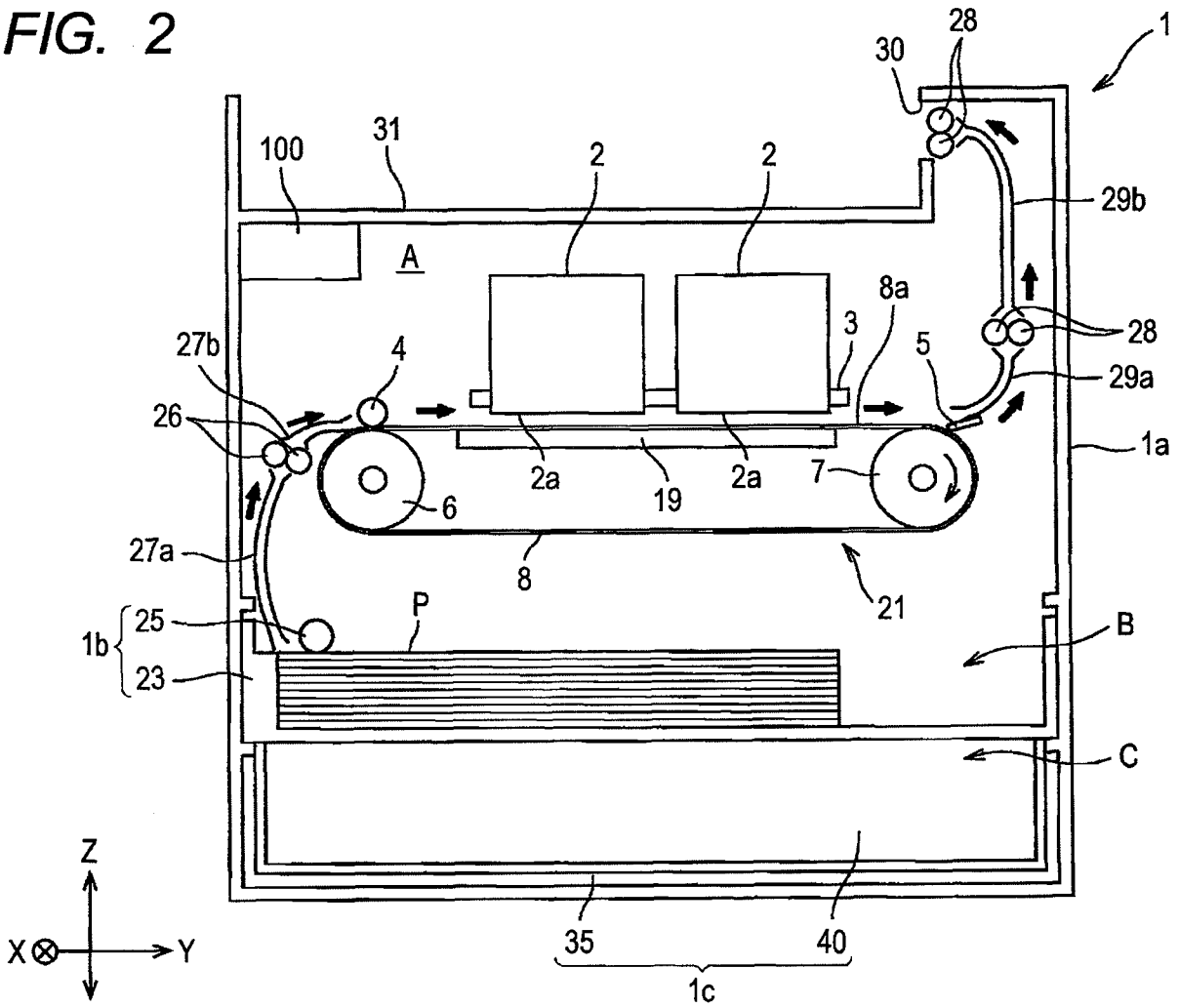
FIG. 2 is a schematic side cross-sectional view showing the interior of the printer.

The head 2 is a line-type head having substantially a rectangular parallelepiped shape elongated in the main scanning direction X (the direction perpendicular to the drawing sheet of FIG. 2). The two heads 2 are arranged in the sub-scanning direction Y with a predetermined pitch, and are supported by the housing 1*a* via a frame 3. A joint to which a flexible tube is attached is provided on the upper surface of each head 2. A large number of ejection ports is formed on the lower surface 2*a* of each head 2. A channel is formed inside of each head 2 so that liquid supplied from a corresponding reservoir 42 of the cartridge 40 can reach the ejection ports via the flexible tube and the joint.

The cartridge unit 1*c* includes a tray 35 and one cartridge 40 disposed within the tray 35. The cartridge 40 includes two reservoirs 42 that accommodate black ink and pre-coat liquid, respectively (see FIG. 4). Liquid accommodated in each reservoir 42 of the cartridge 40 is supplied to a corresponding one of the heads 2 via the flexible tube and the joint.

The tray 35 is detachable from the housing 1*a* in the main scanning direction X in a state in which the cartridge 40 is disposed inside. Accordingly, a user of the printer 1 can replace the cartridge 40 in the tray 35 in a state in which the tray 35 is removed from the housing 1*a*.

The configuration of the cartridge 40 will be described with reference to FIGS. 3 through 7.

Figure 3:
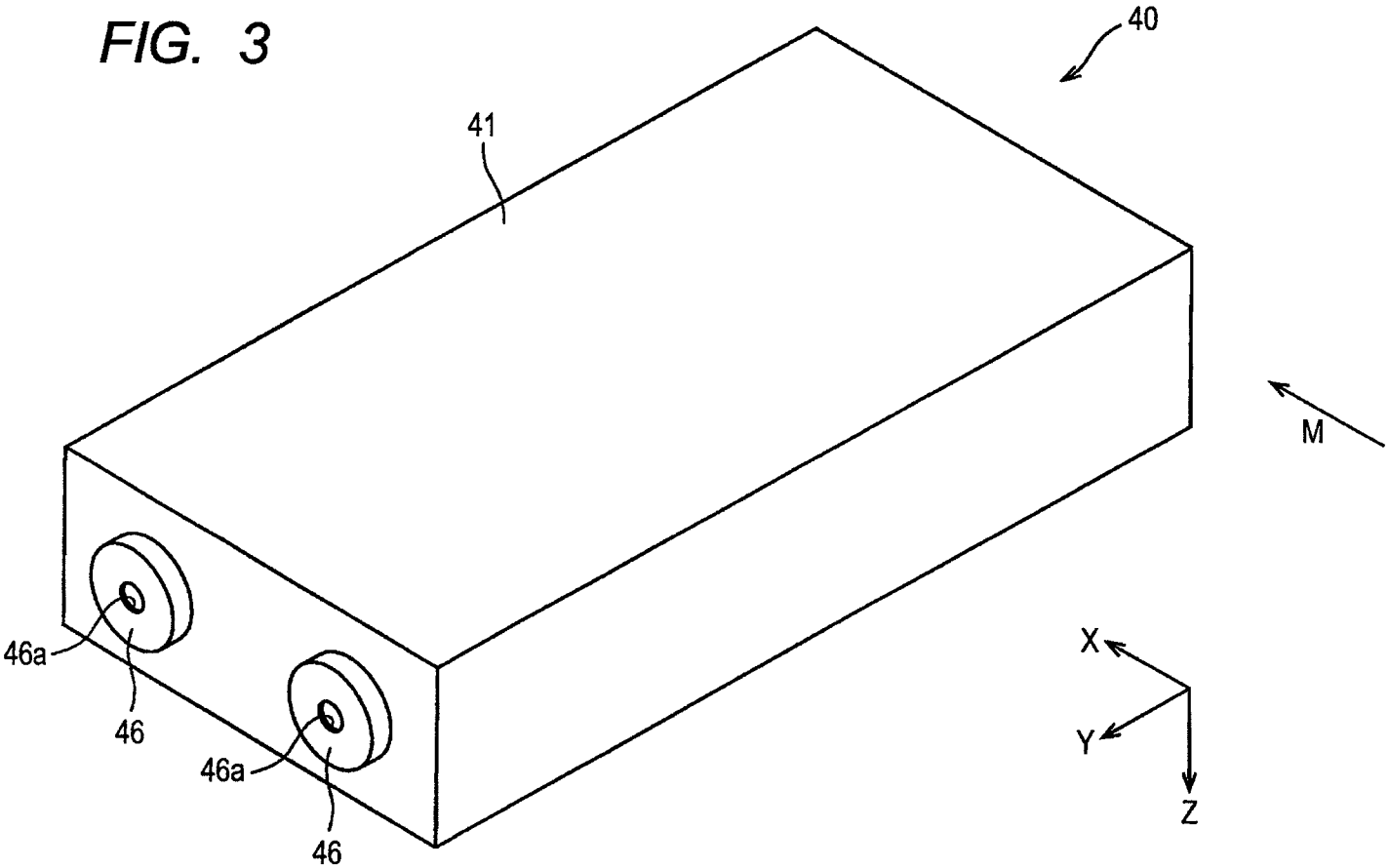
FIG. 3 is a perspective view showing the cartridge according to the first embodiment.
Figure 4:
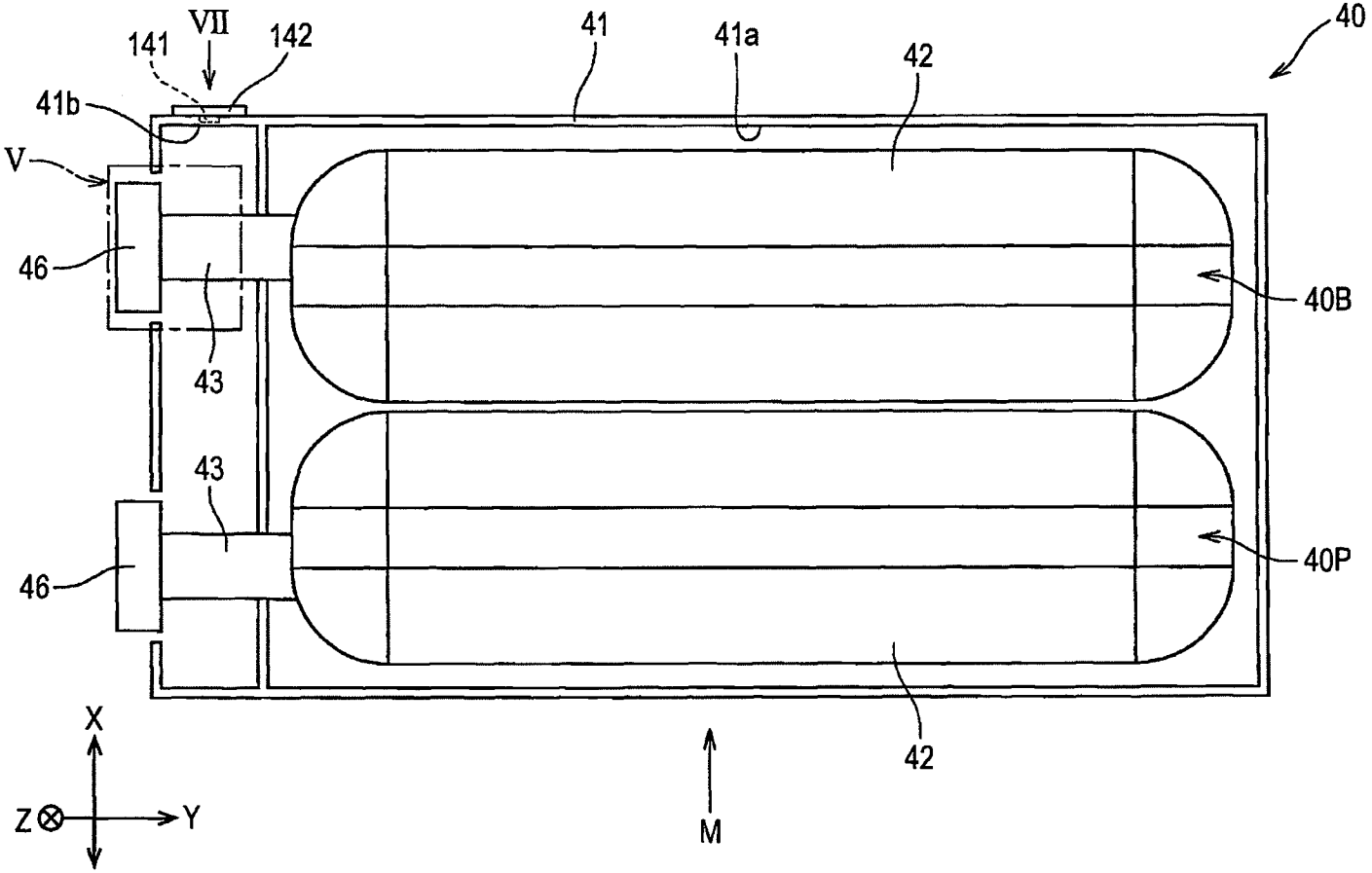
FIG. 4 is a schematic view showing the interior of the cartridge.

As shown in FIGS. 3 and 4, the cartridge 40 includes a housing 41, a black ink unit 40B for black ink, a pre-coat liquid unit 40P for pre-coat liquid, the memory 141, and a board 142. Each of the units 40B and 40P includes the reservoir 42, a supply pipe 43, a plug 50, a valve 60, a sensor unit 70, and the like, and has the same configuration (see FIGS. 4, 5A, and 5B).

As shown in FIG. 3, the housing 41 has a rectangular parallelepiped shape. As shown in FIG. 4, the inside of the housing 41 is divided to form two chambers 41*a* and 41*b*. The reservoir 42 of each of the units 40B and 40P is disposed in the chamber 41*a* at the right side. The supply pipe 43 of each of the units 40B and 40P is disposed in the chamber 41*b* at the left side.

The reservoir 42 is a pouch that stores liquid. The reservoir 42 of the black ink unit 40B stores black ink, and the reservoir 42 of the pre-coat liquid unit 40P stores pre-coat liquid. An opening section of the reservoir 42 is connected with a base end of the supply pipe 43.

The supply pipe 43 defines a supply channel 43*a* (see FIGS. 5A and 5B) for supplying the head 2 with liquid stored in the reservoir 42. As shown in FIG. 4, a distal end of the supply pipe 43 protrudes outside of the housing 41. The distal end of the supply pipe 43 is provided with the plug 50 made of elastic material such as rubber in a compressed state, so as to close the opening 43*b* of the supply channel 43*a* at the opposite side from the reservoir 42 (see FIGS. 5A and 5B). A cap 46 is provided outside of the distal end of the supply pipe 43 and the plug 50. An opening 46*a* is formed at the center of the cap 46, so that a front surface (the surface at the opposite side from a back surface in confrontation with the valve 60) of the plug 50 is exposed through the opening 46*a*.

Figure 5A:
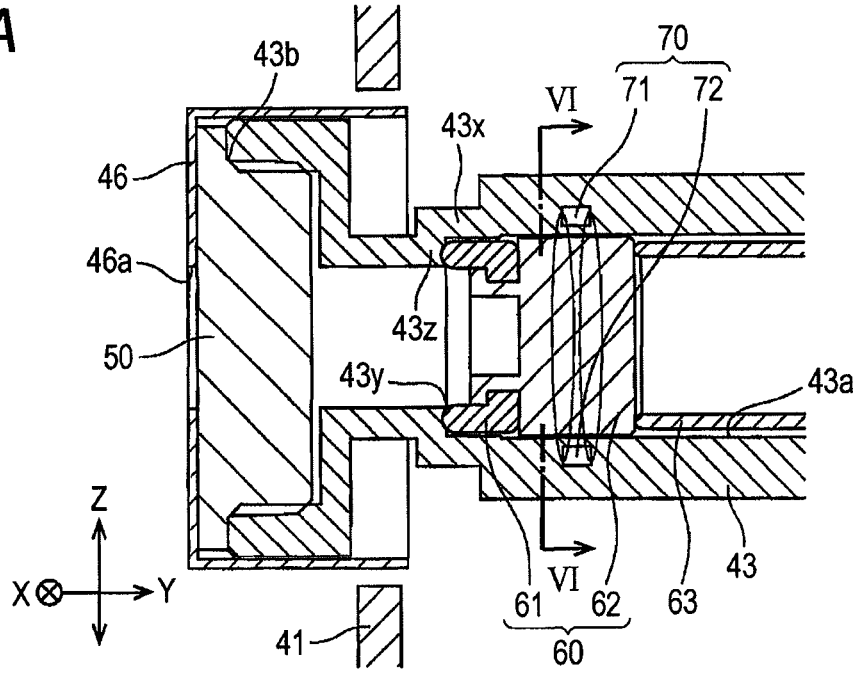
Figure 5B:
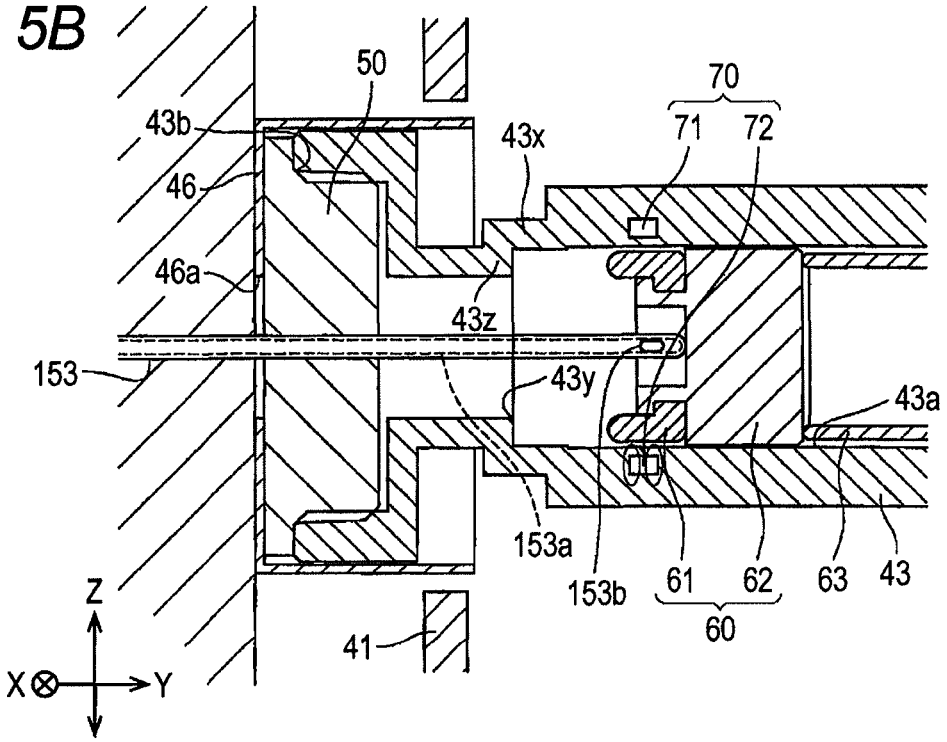

As shown in FIGS. 5A and 5B, the valve 60 is disposed at the supply channel 43*a* and includes an O-ring 61 and a valve main body 62.

Figure 6:
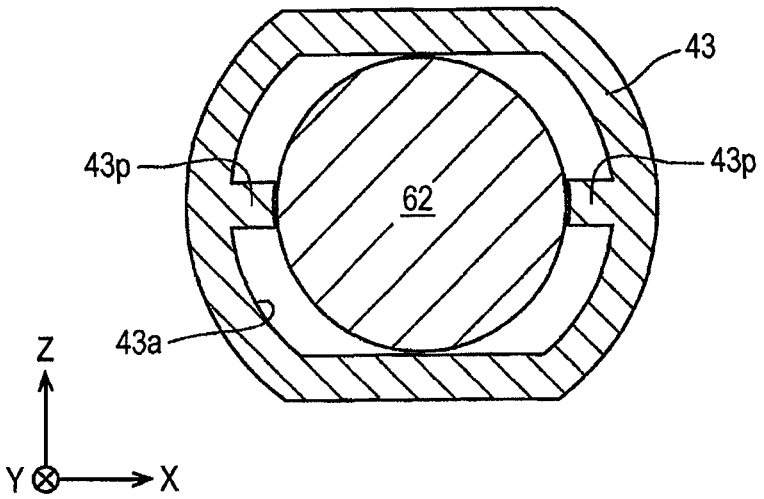
FIG. 6 is a partial cross-sectional view taken along a line VI-VI shown in FIG. 5A.

As shown in FIGS. 5A, 5B, and 6, the valve main body 62 is a magnetic body of a cylindrical shape having an axis in the sub-scanning direction Y.

As shown in FIG. 6, a portion of the supply pipe 43 at which the valve main body 62 is disposed has a cylindrical shape having flat upper and lower walls and having a cross-section elongated in the main scanning direction X, the cross-section being perpendicular to the sub-scanning direction Y. Each of inner surfaces of the supply pipe 43 at both sides in the main scanning direction X is formed with a protrusion 43*p* that protrudes inward in the main scanning direction X. Each protrusion 43*p* extends in the sub-scanning direction Y over a range in which the valve main body 62 is movable. The valve main body 62 is supported by the protrusions 43*p* and the upper and lower walls of the supply pipe 43, and is positioned at the center of the supply channel 43*a* in the cross-section. A channel is secured between the valve main body 62 and the supply pipe 43 at portions except contact portions where the valve main body 62 is in contact with the protrusions 43*p* and the upper and lower walls of the supply pipe 43.

The O-ring 61 is made of elastic material such as rubber, and is fixed to a front surface of the valve main body 62 (the surface that faces the plug 50).

The valve 60 is urged toward an opening 43*y* by a coil spring 63. The coil spring 63 has one end fixed to a base end of the supply pipe 43 and another end in contact with a back surface of the valve main body 62.

As shown in FIG. 5A, when the valve 60 is in a closed position for closing the supply channel 43*a*, the O-ring 61 is in contact with a portion (valve seat) 43*z* that protrudes from one end (the end closer to the opening 43*b*) of a small diameter portion 43*x* of the supply pipe 43 toward the center of the supply pipe 43 in a radial direction, so that the opening 43*y* of one end of the small diameter portion 43*x* is sealed. With this arrangement, fluid communication between the reservoir 42 and the outside via the supply channel 43*a* is blocked. At this time, the O-ring 61 is deformed elastically by urging force of the coil spring 63.

The sensor unit 70 includes the Hall element 71 and a magnet 72. The magnet 72 (magnetic-field generating member) is for generating a magnetic field. The Hall element 71 is a magnetic sensor that converts inputted magnetic field into an electric signal. In the present embodiment, the Hall element 71 generates a potential proportional to magnitude of a magnetic field that changes due to movement of the valve main body 62 (a magnetic body and a movable member) (see FIG. 14B). The Hall element 71 is disposed in a magnetic field created by the magnet 72 and the valve main body 62 (cooperate to serve as a magnetic-field forming section) (see FIG. 5A).

As shown in FIG. 5A, the Hall element 71 and the magnet 72 are fixed to upper and lower walls of the supply pipe 43, respectively, and confront each other in the vertical direction Z.

As shown in FIG. 5A, when the valve 60 is in a closed position, the Hall element 71 and the magnet 72 confront each other with the valve main body 62 interposed therebetween. That is, the valve main body 62 is at a position between the Hall element 71 and the magnet 72. At this time, a magnetic field generated by the magnet 72 reaches the Hall element 71 effectively via the valve main body 62. Accordingly, the magnetic field detected by the Hall element 71 is strong, and the Hall element 71 generates a high potential.

When the valve 60 moves from the closed position shown in FIG. 5A to an open position shown in FIG. 5B where the supply channel 43*a* is opened, the valve main body 62 moves to a position that does not confront the Hall element 71 and the magnet 72 (that is, a position not between the Hall element 71 and the magnet 72) in the vertical direction Z. With this movement, the magnetic field detected by the Hall element 71 becomes weaker, and the potential generated by the Hall element 71 becomes lower.

In this way, the valve main body 62 is linearly movable between an open position where fluid communication between the inside and the outside of the reservoir 42 is allowed and a closed position where fluid communication between the inside and the outside of the reservoir 42 is prohibited. Thus, the open position and the closed position can be switched with a simple configuration of linear movement of the valve main body 62.

The controller 100 receives a signal of a potential generated by the Hall element 71 through sensor-signal output terminals 170*c* and 171 *c* and, based on the potential, determines whether the cartridge 40 is mounted at a predetermined position in the space C and whether the position of the valve 60 is the open position or the closed position. Detailed descriptions will be provided later in terms of potentials generated by the Hall element 71 (output values from the Hall element 71) and the specific method of the above-described determination by the controller 100 based on the potentials.

As shown in FIG. 4, the board 142 is provided on an outer surface of a side wall of the housing 41 at the downstream side in a mounting direction M of the cartridge 40 into the space C (hereinafter, simply referred to as "mounting direction M"). In the present embodiment, the mounting direction M is a direction in parallel with the main scanning direction X.

The memory 141 is disposed at the back side of the board 142. The memory 141 is an EEPROM or the like, and stores data relating to the cartridge 40. Specifically, the memory 141 preliminarily stores data such as a liquid amount (an amount of liquid within each reservoir 42 in a brand-new cartridge 40), sensor output values (output values Vh and V1 from each Hall element 71; see FIGS. 14A and 14B), and a manufacturing date (date, month, and year on which the cartridge 40 is manufactured). The sensor output values are stored in the memory 141 at the time of manufacture or recycling of the cartridge 40, as data unique to the cartridge 40. Further, when the cartridge 40 is mounted on the printer 1, the controller 100 can write, in the memory 141, data relating to a used amount of liquid (a used amount of liquid within each reservoir 42, that is, an amount of liquid ejected from each head 2), a number of insertion of hollow needle (a number by which a hollow needle 153 is inserted in the plug 50), a number of recorded sheets (a number of sheets of paper P on which recording is performed with liquid within the cartridge 40), a cumulative usage period (a time period during which the cartridge 40 is mounted on the printer 1, and is the same as a time period during which the hollow needle 153 is inserted in the supply channel 43*a*), and the like. When the cartridge 40 is mounted on the printer 1, the controller 100 can also read data stored in the memory 141.

Figure 7:
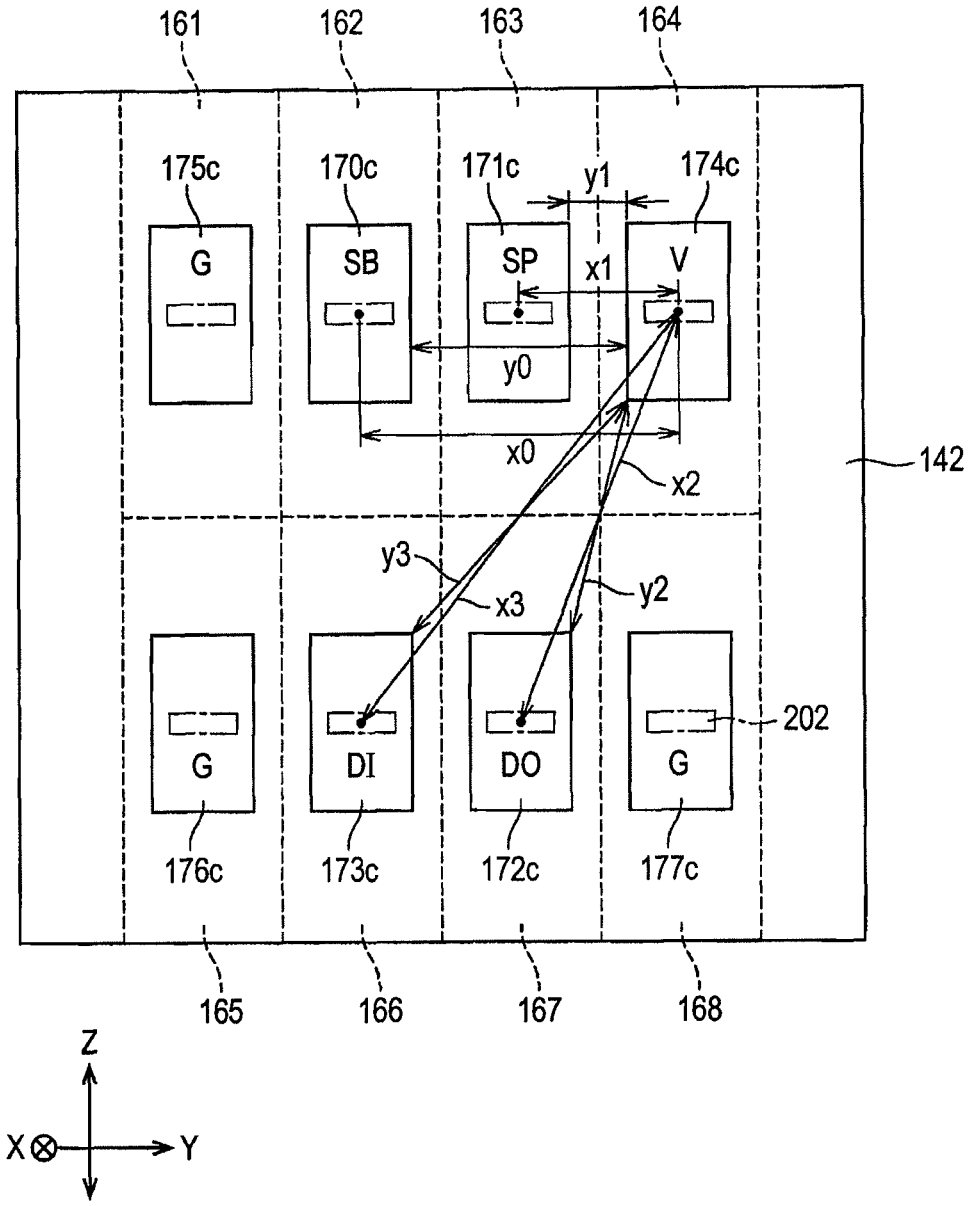
FIG. 7 is a diagram as viewed from a direction VII shown in FIG. 4, for illustrating a terminal of the cartridge.

As shown in FIG. 7, eight terminals 170*c* through 177*c* are provided on a surface of the board 142. All of the terminals 170*c* through 177*c* have the same size and shape, and are exposed on an outer surface of the cartridge 40. Each of the terminals 170*c* through 177*c* has a rectangular shape with two short sides parallel to the sub-scanning direction Y and two long sides parallel to the vertical direction Z. The terminals 170*c* through 177*c* are arranged in two rows.

Center-to-center distances x0-x3 between each terminal 170*c*-173*c* and the terminal 174*c* have relationship of $x1<x0<x2<x3$. Shortest distances y0-y3 between outer edges of each terminal 170*c*-173*c* and the terminal 174*c* have relationship of $y1<y0<y2<y3$. Here, xn (n=0-3) denotes a center-to-center distance between a terminal 17*nc* and the terminal 174*c*, and yn (n=0-3) denotes a shortest distance between the outer edges of the terminal 17*nc* and the terminal 174*c*.

Figure 9A:
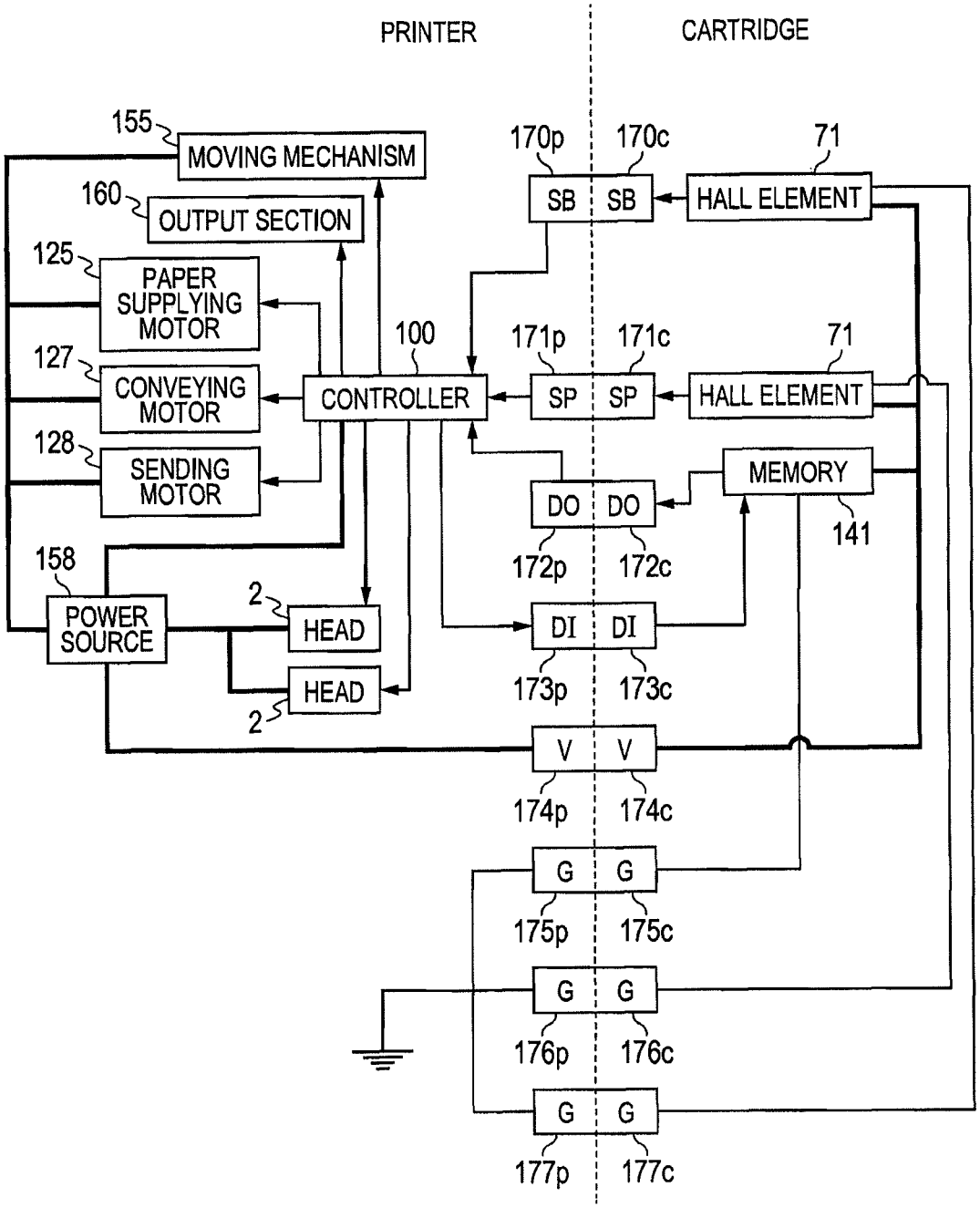
FIG. 9A is a block diagram showing the electrical configuration of the cartridge and the printer.

As shown in FIG. 9A, a sensor-signal output terminal (SB) 170*c* is electrically connected with the Hall element 71 of the black ink unit 40B. A sensor-signal output terminal (SP) 171*c* is electrically connected with the Hall element 71 of the pre-coat liquid unit 40P. A data output terminal (DO) 172*c* and a data input terminal (DI) 173*c* are electrically connected with the memory 141. A power-source terminal (V) 174*c* is electrically connected with the two Hall elements 71 and the memory 141. Three ground terminals (G) 175*c*, 176*c*, and 177*c* are electrically connected with the memory 141, the Hall element 71 of the pre-coat liquid unit 40P, and the Hall element 71 of the black ink unit 40B, respectively.

Figure 8A:
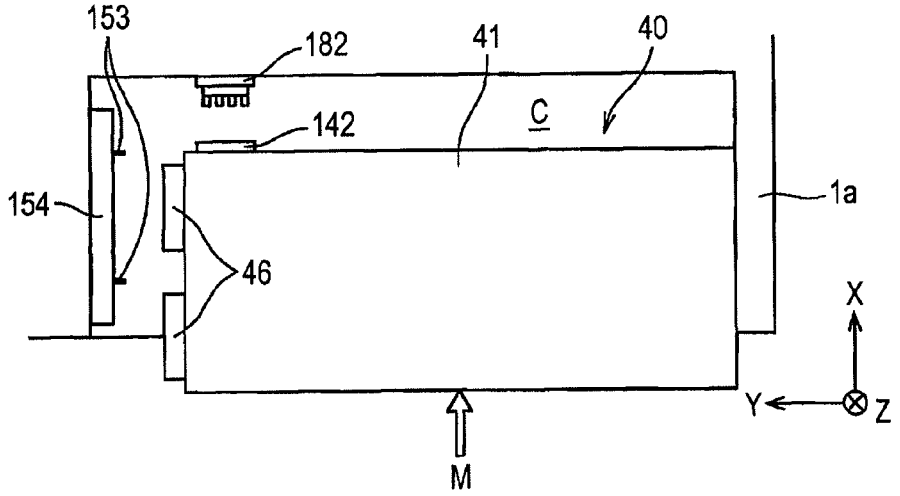
Figure 8B:
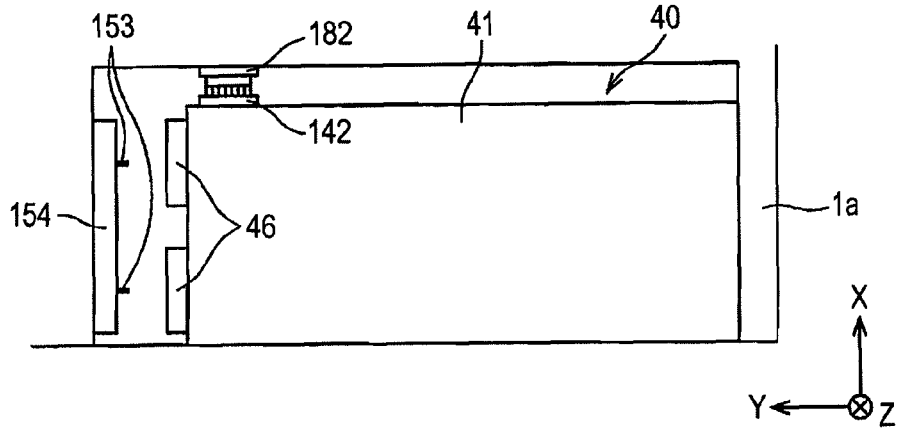
Figure 8C:
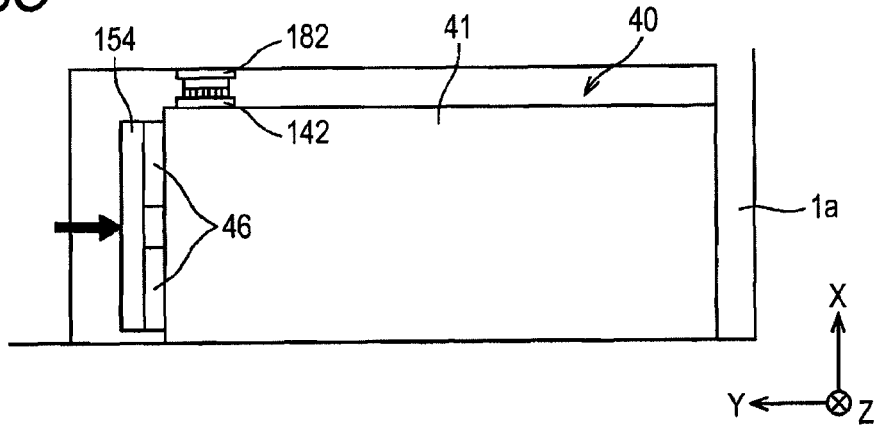
Figure 12:
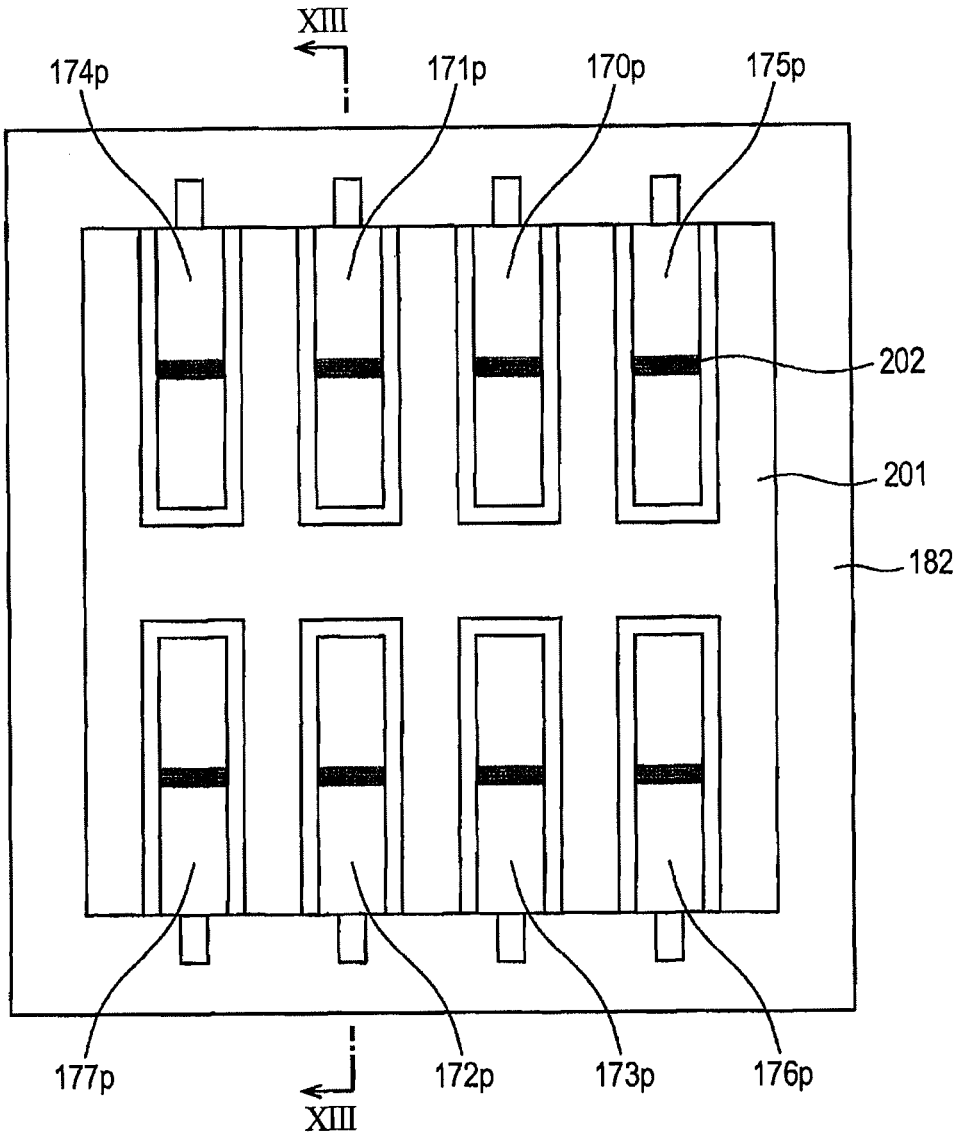
FIG. 12 is a diagram as viewed from a mounting direction M shown in FIG. 8A, for illustrating a terminal of the printer.
Figure 13:
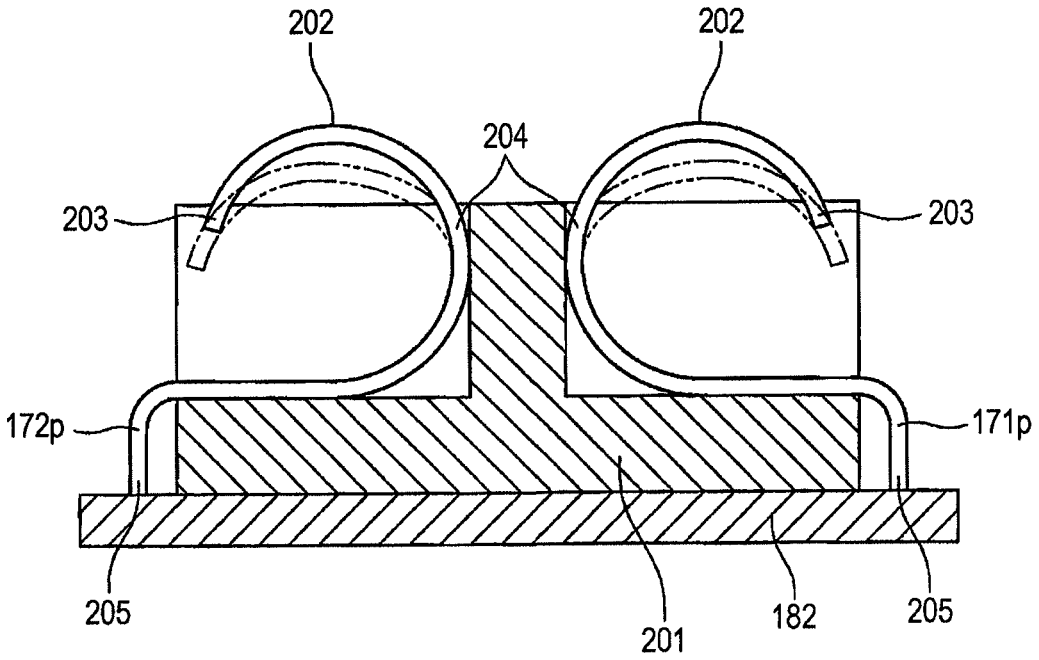
FIG. 13 is a partial cross-sectional view taken along a line XIII-XIII shown in FIG. 12.

As shown in FIGS. 8A through 8C, a board 182 is provided on a wall surface perpendicular to the mounting direction M (the main scanning direction X), the wall surface being one of wall surfaces defining the space C of the housing 1*a*. The board 182 has substantially the same size as the board 142, and is disposed at a position confronting the board 142 when the cartridge 40 is mounted to a predetermined position in the space C (see FIG. 8B). As shown in FIGS. 12 and 13, a base material 201 is provided on a surface of the board 182. Eight terminals 170*p* through 177*p* corresponding to eight terminals 170*c* through 177*c*, respectively, are provided on the base material 201.

As shown in FIG. 13, each of the terminals 170*p* through 177*p* includes a leaf spring having substantially a C-shape in cross-section. One end 205 of each of the terminals 170*p* through 177*p* is a fixed end that is fixed to the board 182, and is electrically connected with the board 182. Another end 203 of each of the terminals 170*p* through 177*p* is a free end that can bend with a part 204 as a fulcrum. The another end 203 is urged upward in FIG. 13 (that is, the direction approaching the terminals 170*c* through 177*c* of the cartridge 40 mounted at the predetermined position in the space C).

The terminals 170*p* through 177*p* are arranged in a mirror symmetry pattern with the pattern of the terminals 170*c* through 177*c* shown in FIG. 7, so as to make contact with the terminals 170*c* through 177*c*, respectively, when the cartridge 40 is mounted at the predetermined position in the space C. Each of the terminals 170*p* through 177*p* is arranged so that each top portion 202 makes contact with the center of a corresponding one of the terminals 170*c* through 177*c*.

As shown in FIG. 9A, a sensor-signal receiving terminal (SB) 170*p*, a sensor-signal receiving terminal (SP) 171*p*, a data receiving terminal (DO) 172*p*, and a data transmitting terminal (DI) 173*p* are electrically connected with the controller 100. A power-source potential input terminal (V) 174*p* is electrically connected with a power source 158. Three ground-potential input terminals (G) 175*p*, 176*p*, and 177*p* are connected with ground. The power source 158 is provided in the housing 1*a*.

Figure 9B:
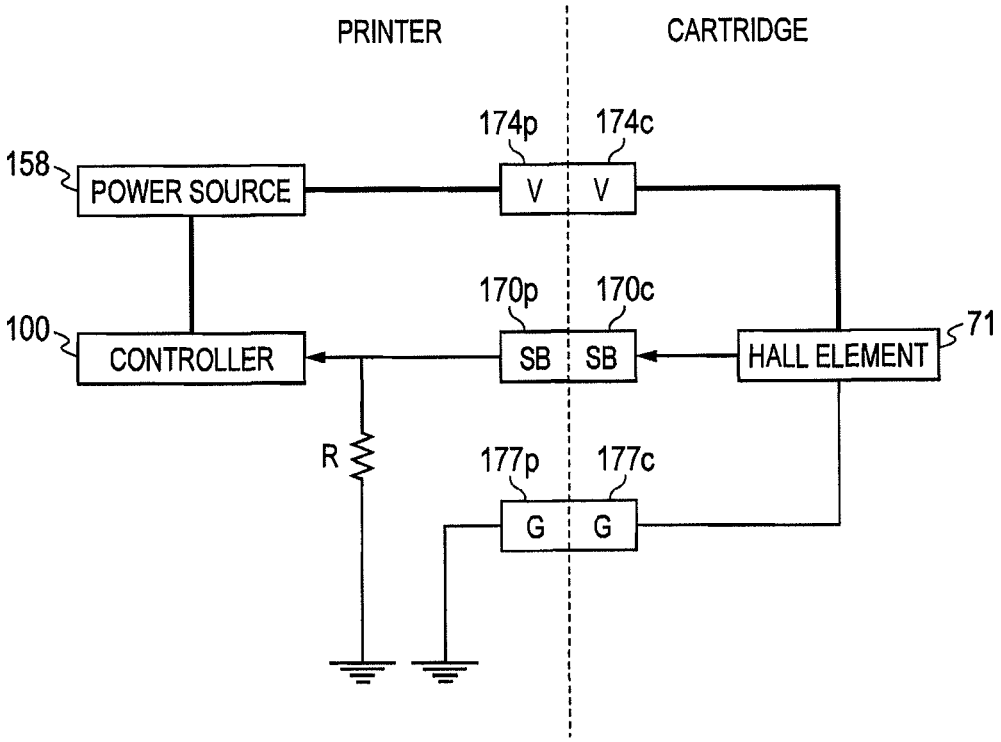
FIG. 9B is a block diagram showing a part of the electrical configuration in FIG. 9A.

Here, a potential received by the controller 100 from the Hall element 71 will be described while referring to FIG. 9B. FIG. 9B is a diagram schematically showing a part of the electrical configuration in FIG. 9A. Note that, although the Hall element 71 for black ink will be described here, the same goes for the Hall element 71 for pre-coat liquid. As shown in FIG. 9B, the controller 100 is connected with ground via a resistance R (not shown in FIG. 9A). Hence, in a state where the cartridge 40 is not mounted on the printer 1 (a state where the circuit is cut off in the vertical dotted line in the center of FIG. 9B), a ground potential is inputted to the controller 100. On the other hand, in a state where the cartridge 40 is mounted on the printer 1, an output potential of the Hall element 71 (a sensor signal) is inputted to the controller 100 via the sensor-signal output terminal 170*c* and the sensor-signal receiving terminal 170*p*.

Next, a process in which the cartridge 40 is mounted to the printer 1 will be described with reference to FIGS. 5A through 14B. In FIGS. 8A through 8C, illustration of the tray 35 is omitted. In FIGS. 9A and 9B, power supply lines are indicated by thick lines, and signal lines are indicated by thin lines.

Before the cartridge 40 is mounted to the printer 1, in each of the units 40B and 40P, the hollow needle 153 is not inserted in the plug 50, and the valve 60 is held in a closed position (see FIG. 5A). At this stage, electrical connection between the terminals 170*c* through 177*c* and the terminals 170*p* through 177*p*, respectively, are not achieved. Accordingly, the Hall elements 71 and the memory 141 are not supplied with electrical power, and the controller 100 cannot perform transmission and reception of signals with the Hall elements 71 and the memory 141.

When the cartridge 40 is mounted to the printer 1, the user of the printer 1 moves the tray 35 in the mounting direction M (the direction indicated by a blanked arrow in FIG. 8A) in a state where the cartridge 40 is placed in the tray 35 (see FIG. 2), thereby inserting the cartridge 40 into the space C of the housing 1*a*. At this time, as shown in FIG. 8B, the cartridge 40 is inserted to a position at which the terminals 170*c* through 177*c* and the terminals 170*p* through 177*p* are in contact with each other.

At the stage of FIG. 8B, the centers of the terminals 170*c* through 177*c* make contact with the top portions 202 of the terminals 170*p* through 177*p*, respectively, so as to achieve electrical connection between the terminals 170*c* through 177*c* and the terminals 170*p* through 177*p*. With this operation, a power-source potential is inputted to the power-source terminal 174*c*, and electrical power is supplied to the Hall element 71 and the memory 141. At this time, a ground potential is inputted to the ground terminals 175*c* through 177*c*. The controller 100 can then perform reception of signals from the Hall element 71 of the black ink unit 40B via the terminals 170*c* and 170*p*, reception of signals from the Hall element 71 of the pre-coat liquid unit 40P via the terminals 171*c* and 171*p*, reading of data from the memory 141 via the terminals 172*c* and 172*p*, and writing of data to the memory 141 via the terminals 173*c* and 173*p*.

In a process in which the cartridge 40 is mounted to the printer 1, immediately before mounting is completely finished, the centers of the terminals 170*c* through 177*c* make contact with the top portions 202 of the terminals 170*p* through 177*p*. Subsequently, before mounting is completely finished, the terminals 170*p* through 177*p* are pressed by the terminals 170*c* through 177*c* so that the another end 203 bends downward with the part 204 as the fulcrum, thereby shifting from a state shown by solid lines in FIG. 13 to a state shown by double-dot chain lines. The top portions 202 of the terminals 170*p* through 177*p* contact the terminals 170*c* through 177*c* in contact regions (regions surrounded by single-dot chain lines in FIG. 7) including the centers of the terminals 170*c* through 177*c* when mounting is completely finished. From a state immediately before mounting is completely finished to a state when mounting is completely finished, the contact regions of the top portions 202 on the terminals in the upper row (the terminals 175*c*, 170*c*, 171*c*, and 174*c*) slide upward gradually from positions slightly below the regions surrounded by single-dot chain lines in FIG. 7, whereas the contact regions of the top portions 202 on the terminals in the lower row (the terminals 176*c*, 173*c*, 172*c*, and 177*c*) slide downward gradually from positions slightly above the regions surrounded by single-dot chain lines in FIG. 7.

A support body 154 is disposed on a wall surface perpendicular to the sub-scanning direction Y and confronting the two caps 46 when the cartridge 40 is mounted to the predetermined position in the space C, the wall surface being one of wall surfaces defining the space C of the housing 1*a*. The support body 154 supports the two hollow needle 153 and is movable in the sub-scanning direction Y relative to the housing 1*a*. The two hollow needles 153 correspond to the head 2 that ejects black ink and the head 2 that ejects pre-coat liquid, respectively, and are in fluid communication with the flexible tube attached to the joint of the corresponding head 2.

At the stage of FIG. 8B, the cartridge 40 is separated from the hollow needles 153, and each reservoir 42 is not in fluid communication with the channel of the corresponding head 2.

Figure 11:
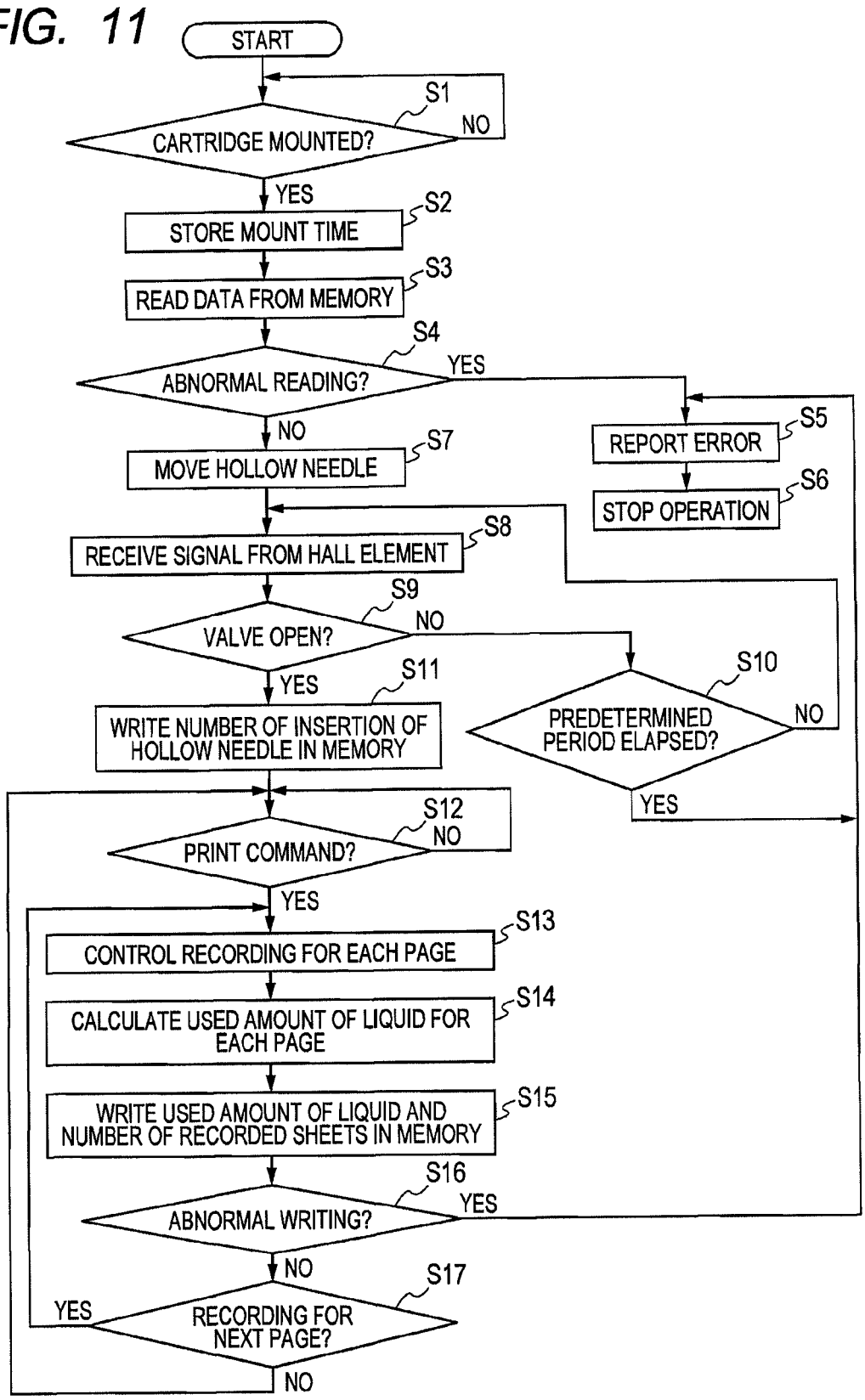
FIG. 11 is a flowchart showing controls performed by the controller of the printer when the cartridge is mounted on the printer.

The controller 100 determines whether the cartridge 40 is mounted at the predetermined position in the space C, based on an output value from the Hall element 71 (S1 in FIG. 11).

Figure 14A:
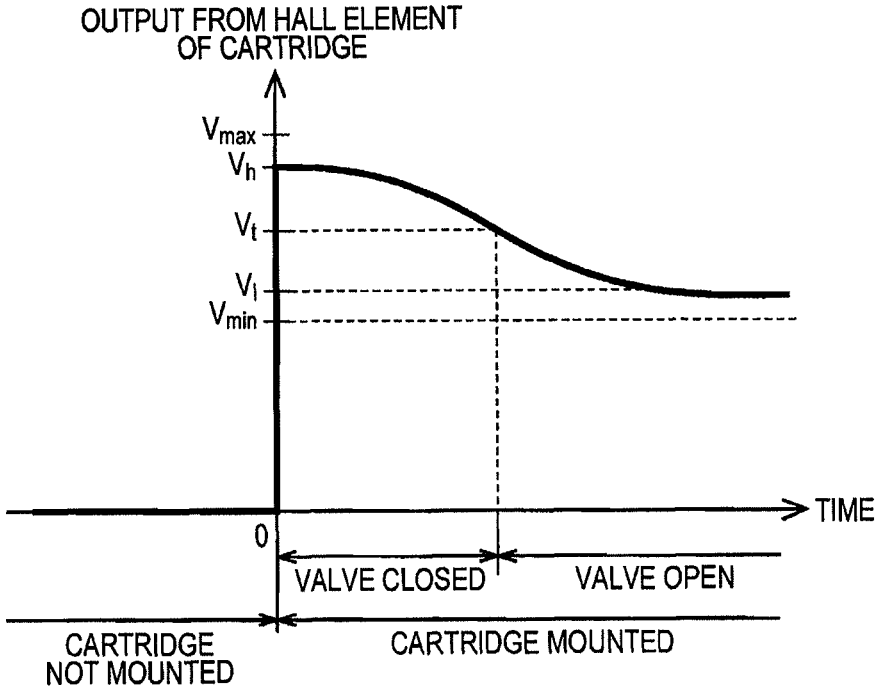
FIG. 14A is a graph showing changes of an output value from a Hall element of the cartridge of the first embodiment in the process in which the cartridge is mounted onto the printer.

Here, changes of the output value from the Hall element 71, in a process where the cartridge 40 is mounted to the printer 1, will be described while referring to FIG. 14A. In FIG. 14A, the horizontal axis indicates time, and the vertical axis indicates output values from the Hall element 71. It is assumed that time 0 is a time point at which the cartridge 40 is mounted at the predetermined position in the space C.

Before the cartridge 40 is mounted at the predetermined position in the space C (when the cartridge is not mounted at the predetermined position in the space C), the output value from the Hall element 71 is kept at a ground potential (0V) (see a "cartridge not mounted" range shown in FIG. 14A). When the cartridge 40 is mounted at the predetermined position in the space C to achieve electrical connection between the terminals 170*c* through 177*c* and the terminals 170*p* through 177*p*, the output value from the Hall element 71 increases from the ground potential to Vh. After that, in a process where the valve 60 moves from the closed position to the open position, the output value from the Hall element 71 gradually decreases from Vh to V1 (see a "cartridge mounted" range shown in FIG. 14A). During a period in which the cartridge 40 is mounted at the predetermined position in the space C, the output value from the Hall element 71 is higher than the ground potential and lower than the power-source potential (Vmax) ($0<Vmin<V1\leq V\leq Vh<Vmax$), regardless of the position of the valve 60.

If the output value V from the Hall element 71 is higher than or equal to Vmin and lower than Vmax ($Vmin\leq V<Vmax$), the controller 100 determines that the cartridge 40 is mounted at the predetermined position in the space C (S1: YES). If the output value V from the Hall element 71 is lower than Vmin ($V<Vmin$), the controller 100 determines that the cartridge 40 is not mounted at the predetermined position in the space C (S1: NO).

The values of Vmax and Vmin are stored in the ROM of the controller 100. In S1, the controller 100 receives signals from the Hall element 71 of each unit 40B, 40P, reads out the values of Vmax and Vmin from the ROM, and makes the above-described determination based on these values and the output value from the Hall element 71.

Note that there are two Hall elements 71 in the present embodiment. Hence, the controller 100 determines that the cartridge 40 is mounted at the predetermined position in the space C when the above-described mounting condition ($Vmin\leq V<Vmax$) is satisfied for both of the two Hall elements 71. Otherwise (for example, in a case where the mounting condition is satisfied for one of the Hall elements 71 but the mounting condition is not satisfied for the other one of the Hall elements 71, etc.), the controller 100 determines that the cartridge 40 is not mounted at the predetermined position in the space C.

If the controller 100 determines that the cartridge 40 is mounted at the predetermined position in the space C as described above (S1: YES), the controller 100 stores time at that time (mount time) in the RAM of the controller 100 (S2). Subsequent to S2, the controller 100 reads data stored in the memory 141 of the cartridge 40 (data relating to the liquid amount, the sensor output value, the manufacturing date, the used amount of liquid, the number of insertion of hollow needle, the number of recorded sheets, the cumulative usage period, and the like) (S3).

Subsequent to S3, the controller 100 determines whether reading in S3 is abnormal (S4). If reading is not performed normally in S3, the controller 100 determines that reading in S3 is abnormal (S4: YES) and uses an output section 160 (see FIG. 9A) such as a display, a speaker, etc. of the printer 1 to report an error (S5). Subsequent to S5, the controller 100 stops operations of each section of the printer 1 (S6).

If reading is abnormal, it is presumed that the memory 141 is damaged by short circuit between the terminal 172*c* and the terminal 174*c*, or that a failure occurs with communication function of the controller 100 by short circuit between the terminal 173*c* and the terminal 174*c*.

If reading is performed normally in S3, the controller 100 determines that reading is not abnormal (S4: NO) and controls a moving mechanism 155 (see FIG. 9A) to move the support body 154 together with the two hollow needles 153 supported by the support body 154 in the sub-scanning direction Y (the direction indicated by a filled arrow in FIG. 8C) (S7).

With movement of the hollow needle 153 in S7, as shown in FIG. 5B, in each of the units 40B and 40P, first, the hollow needle 153 penetrates a substantial center of the plug 50 via the opening 46*a* in the sub-scanning direction Y.

At this time, an opening 153*b* formed at the distal end of the hollow needle 153 is located in the supply channel 43*a*, so that a channel 153*a* in the hollow needle 153 and the supply channel 43*a* are in fluid communication with each other via the opening 153*b*. Although a hole is formed in the plug 50 by the hollow needle 153 at this time, a portion of the plug 50 around the hole closely contacts the outer circumferential surface of the hollow needle 153 by elasticity. This suppresses liquid leakage from between the hole in the plug 50 and the hollow needle 153.

Subsequently, the distal end of the hollow needle 153 abuts the valve main body 62. Then, further penetration of the hollow needle 153 into the supply channel 43*a* causes the valve main body 62 to move together with the O-ring 61 and causes the O-ring 61 to separate from the valve seat 43*z* (see FIG. 5B). At this time, the position of the valve 60 changes from a closed position to an open position.

When the valve 60 is in the open position, fluid communication between the reservoir 42 and the outside is allowed via the supply channel 43*a*. That is, as shown in FIG. 5B, when the plug 50 is penetrated by the hollow needle 153 and the valve 60 is in the open position, the reservoir 42 is in fluid communication with the channel of the head 2 via the supply channel 43*a*, the channel 153*a*, and the like.

Subsequent to S7, the controller 100 receives a signal from the Hall element 71 of each of the units 40B and 40P (S8). Subsequent to S8, the controller 100 determines whether the valve 60 is disposed at the open position in each of the units 40B and 40P (that is, whether fluid communication is formed between the reservoir 42 and the head 2 so that liquid is supplied from the reservoir 42 to the head 2 via the hollow needle 153), based on the output values Vh and V1 read from the memory 141 in S3 and on the signal received in S8 (S9). In the present embodiment, determination in S9 is performed as described below.

That is, as shown in FIG. 14A, the controller 100 determines that the valve 60 is in the open position (S9: YES) if the output value V from the Hall element 71 received in S8 is lower than or equal to a threshold value Vt ($V\leq Vt$) calculated based on the output values Vh and V1 read in S3 (for example, $Vt=(Vh+V1)/2$), and determines that the valve 60 is in the closed position (S9: NO) if the output value V from the Hall element 71 exceeds the threshold value Vt ($Vt<V$).

Figure 14B:
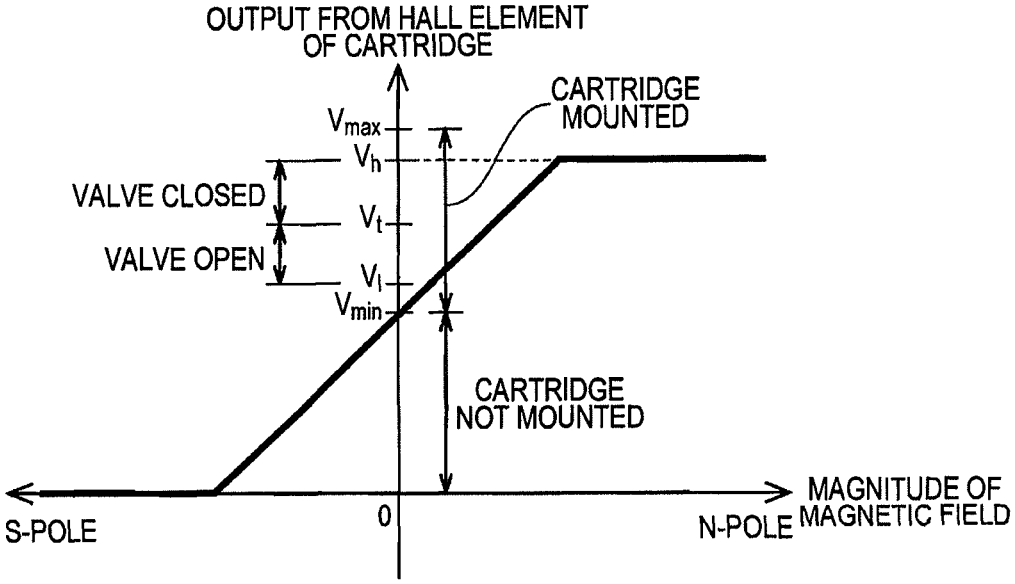
FIG. 14B is a graph showing relationship between magnitude of a magnetic field and the output value from the Hall element in the cartridge of the first embodiment.

As shown in FIG. 14B, the Hall element 71 of the present embodiment generates a potential higher than the ground potential ($V=Vmin>0$) when the Hall element 71 is disposed in a magnetic field of magnitude 0.

If a predetermined period elapses while the valve 60 of each of the units 40B and 40P is not disposed in the open position (S10: YES), the controller 100 reports an error (S5) and stops operations of each section of the printer 1 (S6).

In this case, it is presumed that the Hall element 71 of the black ink unit 40B is damaged by short circuit between the terminal 170*c* and the terminal 174*c*, that the Hall element 71 of the pre-coat liquid unit 40P is damaged by short circuit between the terminal 171*c* and the terminal 174*c*, that a failure occurs with communication function of the controller 100 by short circuit between the terminal 173*c* and the terminal 174*c*, or that a failure occurs with the plug 50, the valve 60, the hollow needle 153 and the moving mechanism 155 of the printer 1, etc.

If the controller 100 determines that the valve 60 of each of the units 40B and 40P is disposed in the open position (S9: YES), the controller 100 writes, in the memory 141, data indicative of a value obtained by adding one to the number of insertion of hollow needle read in S3 (S11). Subsequent to S11, the controller 100 determines whether a print command from an external device has been received (S12).

If a print command is received (S12: YES), the controller 100 controls driving of a paper supplying motor 125, a conveying motor 127, the feed motor 128, the head 2, and the like to perform recording for each page of paper P (S13). Subsequent to S13, the controller 100 calculates the used amount of liquid for each page of paper P (that is, the amount of each liquid of black ink and pre-coat liquid ejected for one page of the paper P that is recorded this time) (S14).

Subsequent to S14, the controller 100 writes, in the memory 141, data indicative of the used amount of each liquid (the amount of liquid in each reservoir 42 that has been used since the cartridge 40 is a brand-new cartridge, that is, a value obtained by adding the used amount of liquid for each page calculated in S14 to the used amount of liquid read in S3) and the number of recorded sheets (the number of sheets of paper P on which recording has been performed with the cartridge 40 since the cartridge 40 is a brand-new cartridge, that is, a value obtained by adding one to the number of recorded sheets read in S3) (S15).

Subsequent to S15, the controller 100 determines whether writing in S15 is abnormal (S16). If writing is not performed normally in S15, the controller 100 determines that writing in S15 is abnormal (S16: YES), reports an error (S5), and stops operations of each section of the printer 1 (S6).

If writing is abnormal, it is presumed that the memory 141 is damaged by short circuit between the terminal 172*c* and the terminal 174*c*, or that a failure occurs with communication function of the controller 100 by short circuit between the terminal 173*c* and the terminal 174*c*.

If writing is performed normally in S15, the controller 100 determines that writing is not abnormal (S16: NO), and determines whether there are recording data for the next page, based on image data included in the print command received in S12 (S17).

If there are recording data for the next page (S17: YES), the controller 100 returns to S13 and repeats the above-described series of steps S13 through S16. On the other hand, if there are no recording data for the next page (S17: NO), the controller 100 returns to S12 and waits until a print command is received again.

Note that the printer 1 includes a lock mechanism (not shown) for locking the cartridge 40. If the controller 100 determines that the cartridge 40 is mounted at the predetermined position in the space C (S1: YES), the controller 100 drives the lock mechanism concurrently with the process in S2, for example, to lock the cartridge 40 together with the tray 35 at the predetermined position.

In order to dismount the cartridge 40 from the printer 1, the user of the printer 1 presses a lock release button. If the controller 100 detects pressing of the lock release button, the controller 100 first controls the moving mechanism 155 (see FIG. 9A) to move the support body 154 in the direction opposite from the filled arrow in FIG. 8C so that the support body 154 returns from the position of FIG. 8C to the position of FIG. 8B. At this time, in each of the units 40B and 40P, as the hollow needle 153 moves in the leftward direction in FIG. 5B, urging force of the coil spring 63 causes the valve 60 to move in the leftward direction in FIG. 5B to make contact with the valve seat 43*z*. With this operation, the position of the valve 60 shifts from the open position to the closed position. The controller 100 determines that the valve 60 is in the closed position when the output value from the Hall element 71 exceeds the threshold value Vt in each of the units 40B and 40P and, based on that time (dismount time) and mount time stored in S2, calculates the cumulative usage period (a time period from the mount time until the dismount time). The controller 100 writes, in the memory 141, data indicative of a value obtained by adding the cumulative usage period read in S3 to the calculated cumulative usage period (that is, the value is the cumulative usage period during which the cartridge 40 is mounted on the printer 1 since the cartridge 40 is a brand-new cartridge). Subsequently, the hollow needle 153 is pulled out of the plug 50. At this time, a hole formed in the plug 50 by the hollow needle 153 becomes small to an extent that liquid leakage is suppressed, due to elasticity of a portion of the plug 50 around the hole.

Subsequently, the controller 100 drives the lock mechanism to unlock the cartridge 40. With this operation, the user can pull the tray 35 out of the space C. When the tray 35 is pulled out of the space C, the board 142 separates from the board 182. Thus, electrical connections between the terminals 170*c* through 177*c* and the terminals 170*p* through 177*p* are disconnected, which stops power supply to the Hall elements 71 and the memory 141 and which prevents the controller 100 from performing transmission and reception of signals with the Hall elements 71 and the memory 141.

The controller 100 displays a value obtained by subtracting the used amount of liquid written in the memory 141 in S15 from the liquid amount read in S3, as the remaining amount of each liquid, on the display of the printer 1.

Figure 10:
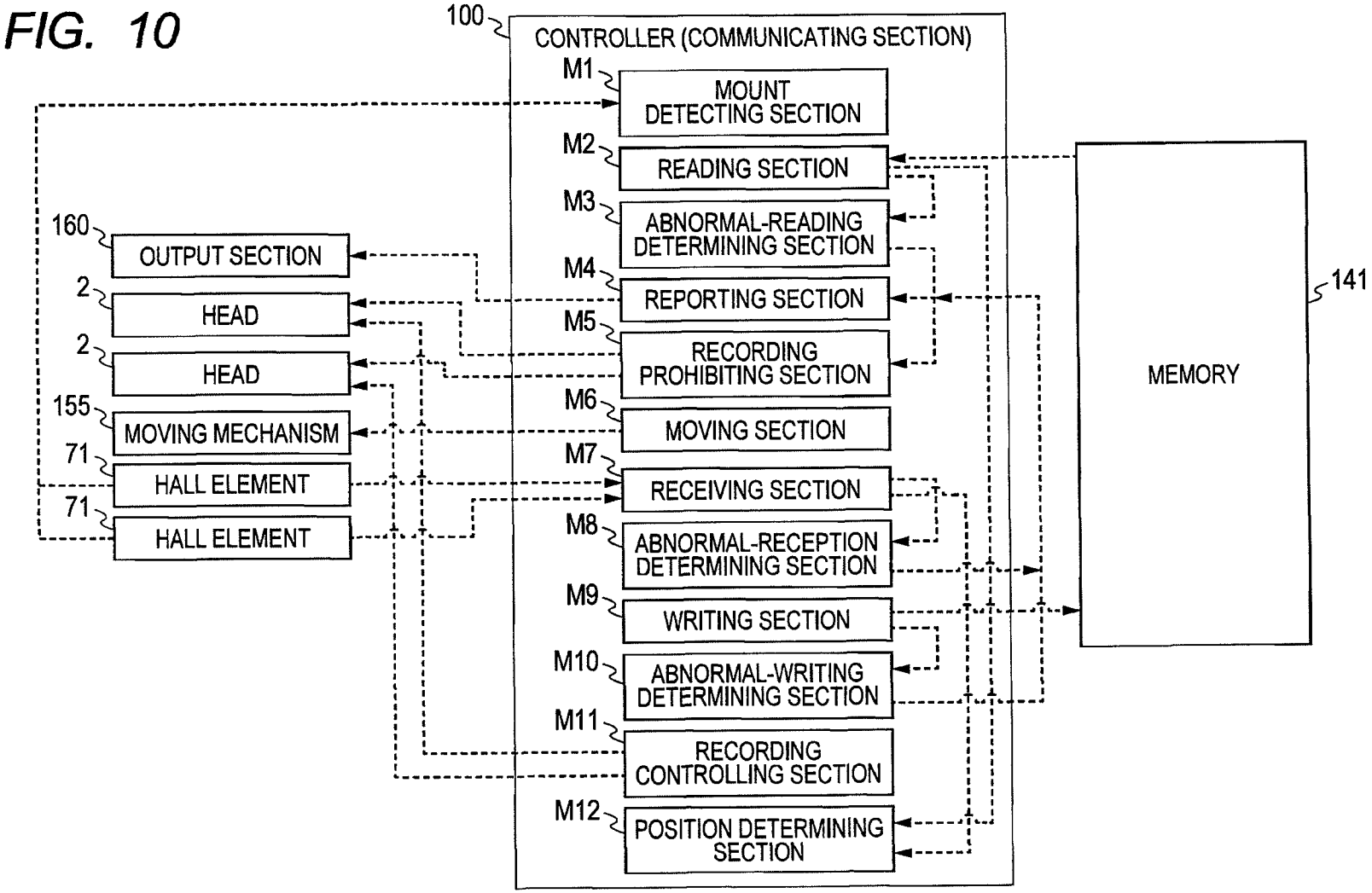
FIG. 10 is a functional block diagram showing each functioning section constructed by a controller of the printer.

As shown in FIG. 10, the controller 100 serves as a communication section that communicates with the cartridge 40 mounted in the space C, and also serves as each functioning section corresponding to processes in FIG. 11. A mount detecting section M1 corresponds to S1, a reading section M2 corresponds to S3, an abnormal-reading determining section M3 corresponds to S4, a reporting section M4 corresponds to S5, a recording prohibiting section M5 corresponds to S6, a moving section M6 corresponds to S7, a receiving section M7 corresponds to S8, an abnormal-reception determining section M8 corresponds to S9 and S10, a writing section M9 corresponds to S11 and S15, an abnormal-writing determining section M10 corresponds to S16, a recording controlling section M11 corresponds to S13, and a position determining section M12 corresponds to S9.

As described above, according to the first embodiment, in order to determine whether the cartridge 40 is mounted at the predetermined position in the space C (S1 in FIG. 11), reliability in mounting determination can be secured while utilizing the Hall element 71 that is provided for a different purpose from the mounting determination (a purpose of determining the position of the valve 60 in the present embodiment). That is, it is determined whether the cartridge 40 is mounted at the predetermined position in the apparatus main body, by utilizing the sensor (the Hall element 71 in the present embodiment) configured to generate a potential based on a position of the movable member that is movable in the supply channel 43*a* (the valve main body 62 in the present embodiment). Hence, a cost increase of the cartridge 40 can be suppressed. Further, even if the sensor generates a potential that is not generated at normal times, due to movement malfunction of the movable member, no erroneous determination is made, thereby improving reliability in determination.

Figure 15A:
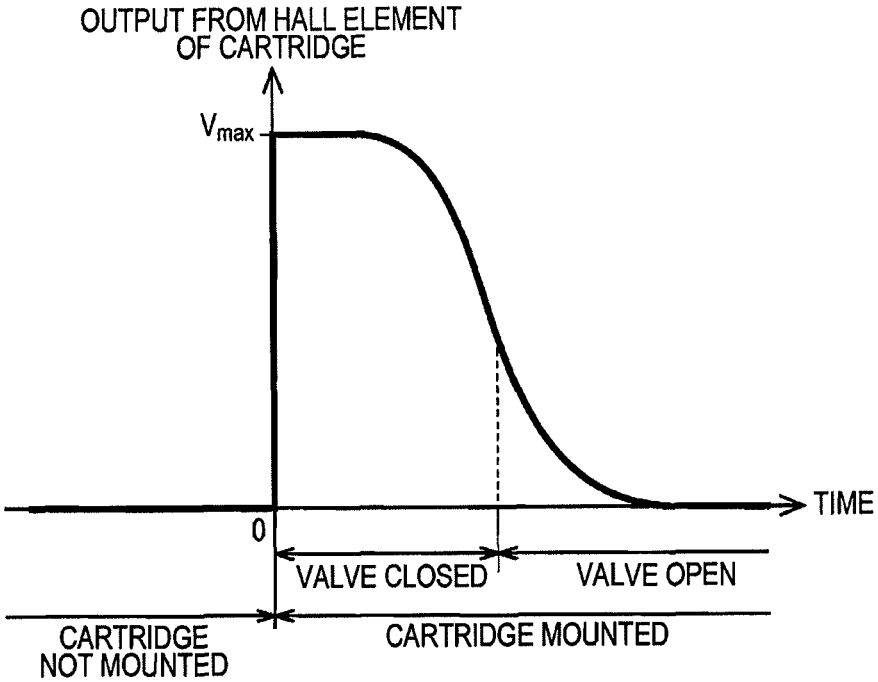
FIG. 15A is a graph showing changes of an output value from a Hall element of a cartridge of a comparative example in a process in which the cartridge is mounted onto the printer.

Specifically, for example, in a configuration where the output value from the Hall element 71 changes as shown in FIG. 15A (comparative example), when the cartridge 40 is mounted at the predetermined position in the space C, there are a case where the output value from the Hall element 71 is higher than the ground potential (mainly, a closed state of the valve) and a case where the output value from the Hall element 71 is the same as the ground potential (mainly, an open state of the valve). When the cartridge 40 is not mounted at the predetermined position in the space C, the output value from the Hall element 71 (actually, the potential inputted to the controller 100) is the same as the ground potential (see FIG. 9B). That is, potentials that can be generated by the Hall element 71 when the cartridge 40 is mounted at the predetermined position in the space C include a potential that is inputted to the controller 100 when the cartridge 40 is not mounted at the predetermined position in the space C.

Figure 17:
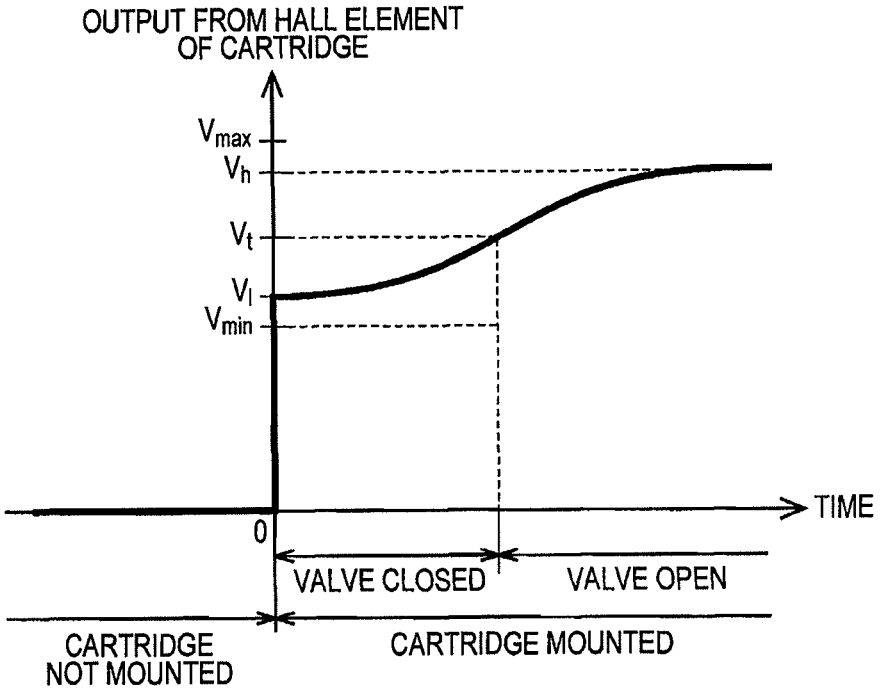
FIG. 17 is a graph showing changes of an output value from a Hall element of the cartridge of the second embodiment in a process in which the cartridge is mounted onto the printer.

Note that, in a state where the cartridge 40 is not mounted at the predetermined position in the space C, the printer 1 and the cartridge 40 are not electrically connected with each other, and thus the output value from the Hall element 71 is not inputted to the controller 100. In FIGS. 14A, 15A, and 17, it is labeled "Output from Hall element of cartridge" for convenience, even in a state where the cartridge is not mounted.

In this configuration, if the cartridge 40 is mounted in the space C while the valve 60 remains at the open position (for example, in a case where a once-mounted cartridge 40 is mounted again, a failure occurs, such as that the valve 60 is stuck in the supply channel 43*a* when returning from the open position to the closed position, and the failure remains unresolved), the Hall element 71 outputs a potential that is the same as the ground potential. The ground potential is a potential that is inputted to the controller 100 when the cartridge 40 is not mounted at the predetermined position in the space C. Hence, in this case, although the cartridge 40 is mounted at the predetermined position in the space C, the controller 100 determines that the cartridge is not mounted.

On the other hand, in the present embodiment, as shown in FIG. 14A, the output value from the Hall element 71 is always higher than the ground potential when the cartridge 40 is mounted at the predetermined position in the space C, and the potential inputted to the controller 100 is the same as the ground potential when the cartridge 40 is not mounted at the predetermined position in the space C. That is, the potentials that can be generated by the Hall element 71 when the cartridge 40 is mounted at the predetermined position in the space C do not include the potential that is inputted to the controller 100 when the cartridge 40 is not mounted at the predetermined position in the space C. In other words, the potential that can be generated by the Hall element 71 when the cartridge 40 is mounted at the predetermined position in the space C is distinguishable from the potential that is inputted to the controller 100 when the cartridge 40 is not mounted at the predetermined position in the space C.

In the present embodiment, even if the cartridge 40 is mounted in the space C while the valve 60 remains at the open position, the Hall element 71 does not output a potential that is the same as the ground potential (the potential that is inputted to the controller 100 when the cartridge 40 is not mounted at the predetermined position in the space C). Accordingly, the controller 100 does not determine that the cartridge 40 is not mounted at the predetermined position in the space C despite a fact that the cartridge 40 is mounted at the predetermined position in the space C. That is, the above-described error in mounting determination can be suppressed, and reliability in mounting determination can be secured.

Figure 15B:
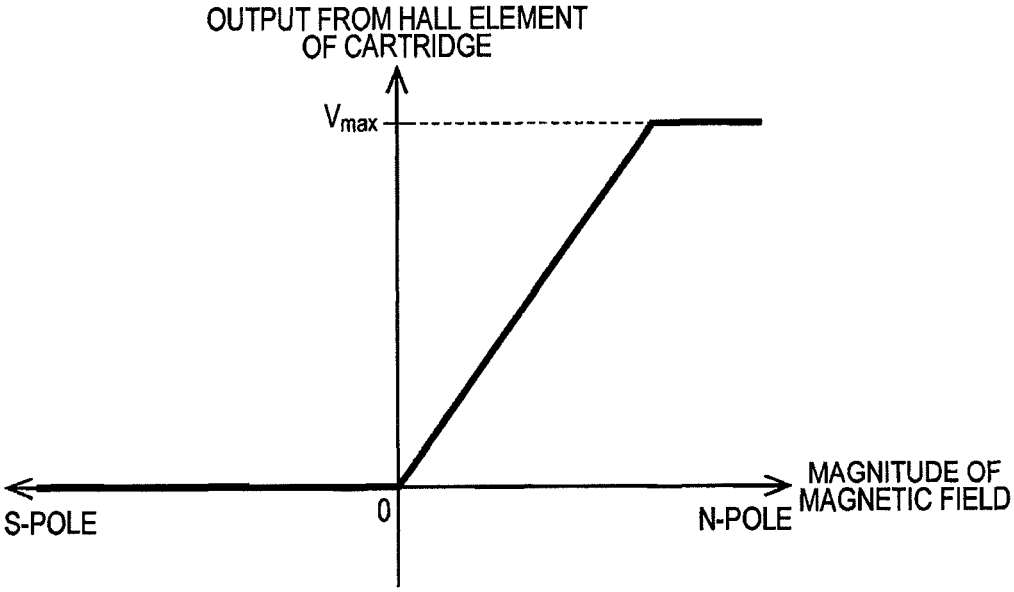
FIG. 15B is a graph showing relationship between magnitude of a magnetic field and the output value from the Hall element in the cartridge of the comparative example.

As in the comparative example shown in FIG. 15B, in a case where such a Hall element is adopted that, when disposed in a magnetic field of magnitude 0, generates a potential that is the same as a ground potential, in order to satisfy a condition that "the output value from the Hall element is higher than the ground potential regardless of the position of the valve 60", a moving range of the valve 60 needs to be set such that the moving range does not include a position at which a magnetic field becomes magnitude 0.

On the other hand, in the present embodiment, as shown in FIG. 14B, such a Hall element 71 is adopted that, when disposed in a magnetic field of magnitude 0, generates a potential that is higher than a ground potential (V=Vmin>0). Hence, without making a special arrangement as described above, the condition is satisfied that "the output value from the Hall element 71 is higher than the ground potential regardless of the position of the valve 60". That is, the degree of freedom of design improves.

There are cases that the power-source potential input terminal 174*p* and the sensor-signal receiving terminal 170*p*, 171*p* are short-circuited, and that the controller 100 receives a power-source potential from the sensor-signal receiving terminal 170*p*, 171*p*. The controller 100 recognizes the potential received from the sensor-signal receiving terminal 170*p*, 171*p* as the potential outputted from the sensor-signal output terminal 170*c*, 171*c* (that is, the potential generated by the Hall element 71).

For example, in a configuration where the output value from the Hall element 71 changes as shown in FIG. 15A, if a power-source potential is received from the sensor-signal receiving terminal 170*p*, 171*p* due to the above-described short-circuit, the controller 100 determines that the cartridge 40 is mounted at the predetermined position in the space C although the cartridge 40 is not mounted. This is because the power-source potential (Vmax) is a potential that can be generated by the Hall element 71 when the cartridge 40 is mounted at the predetermined position in the space C.

On the other hand, in the present embodiment, as shown in FIG. 14A, when the cartridge 40 is mounted at the predetermined position in the space C, the output value from the Hall element 71 is always lower than the power-source potential (Vmax). The controller 100 determines that the cartridge 40 is mounted at the predetermined position in the space C if the output value V from the Hall element 71 is higher than or equal to Vmin and lower than Vmax (Vmin≤V<Vmax). Hence, if the power-source potential is received from the sensor-signal receiving terminal 170*p*, 171*p* due to the above-described short-circuit, the controller 100 does not determine that the cartridge 40 is mounted at the predetermined position in the space C despite a fact that the cartridge 40 is not mounted at the predetermined position in the space C. This is because the power-source potential (Vmax) is a potential outside a range in which it is determined that the cartridge 40 is mounted at the predetermined position in the space C. That is, the above-described error in mounting determination can be suppressed, and reliability in mounting determination can be secured more reliably.

The power-source terminal 174*c*, the ground terminals 175*c* through 177*c*, and the sensor-signal output terminals 170*c* and 171 *c* are arranged on the same plane. With this arrangement, electrical connection between the power-source terminal 174*c* and the power-source potential input terminal 174*p*, electrical connection between the ground terminals 175*c* through 177*c* and the ground-potential input terminals 175*p* through 177*p*, and electrical connection between the sensor-signal output terminals 170*c*, 171 *c* and the sensor-signal receiving terminals 170*p*, 171*p* can be performed substantially at the same time. Thus, reliability in mounting determination can be secured even more reliably.

Next, second through fourth embodiments of the invention will be described while referring to FIGS. 16A through 19B, wherein like parts and components are designated by the same reference numerals to avoid duplicating descriptions.

First, the second embodiment of the invention will be described while referring to FIGS. 16A, 16B, and 17. The second embodiment has substantially the same configuration as the first embodiment, except the positions of the Hall element 71 and the magnet 72 and the process S9 in FIG. 11.

As can be seen from comparison between FIGS. 16A, 16B and FIGS. 5A, 5B, the Hall element 71 and the magnet 72 in the second embodiment are located at positions further spaced away from the plug 50 in the sub-scanning direction Y, than in the first embodiment.

Figure 16A:
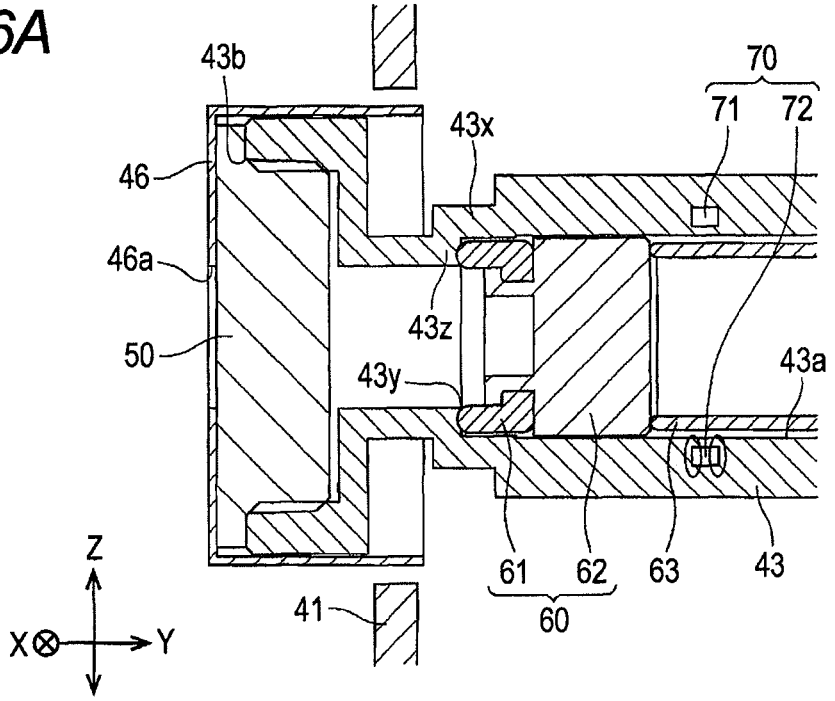
FIGS. 16A and 16B are partial cross-sectional views showing a cartridge according to a second embodiment of the invention, and show states in a closed position and in an open position, respectively.

As shown in FIG. 16A, when the valve 60 is at the closed position, the Hall element 71 and the magnet 72 do not confront the valve main body 62 in the vertical direction Z. That is, the valve main body 62 is located at a position not between the Hall element 71 and the magnet 72. At this time, the magnetic field detected by the Hall element 71 is weak, and the Hall element 71 generates a low potential.

Figure 16B:
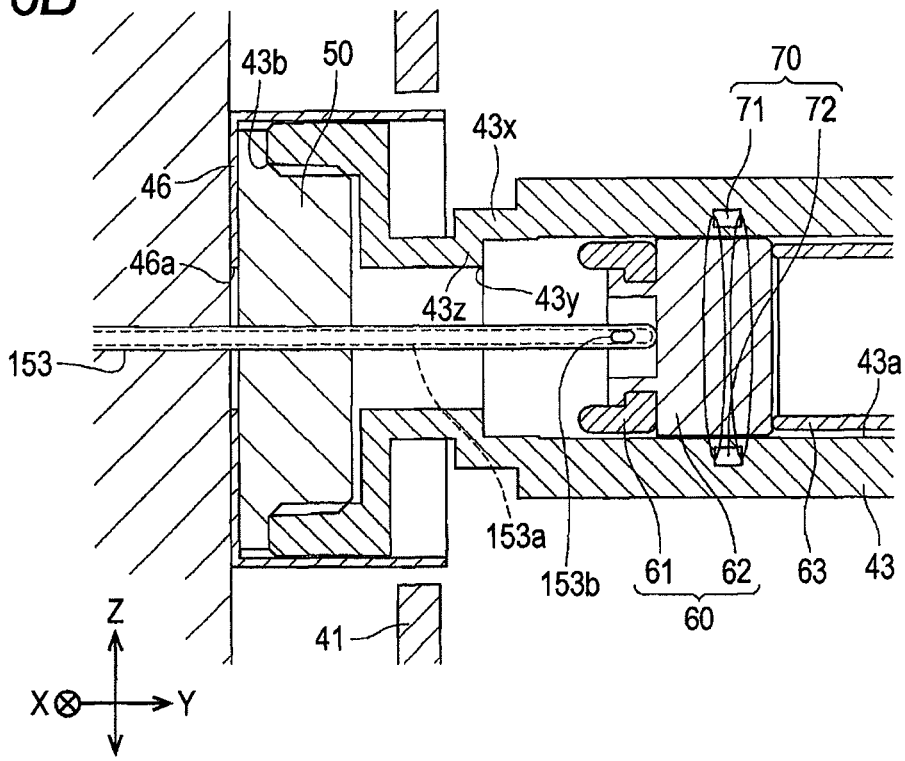

When the valve 60 moves from the closed position shown in FIG. 16A to the open position shown in FIG. 16B, the valve main body 62 moves to a position confronting the Hall element 71 and the magnet 72 in the vertical direction Z (that is, a position between the Hall element 71 and the magnet 72). With this movement, the magnetic field generated by the magnet 72 reaches the Hall element 71 efficiently via the valve main body 62. Accordingly, the magnetic field detected by the Hall element 71 becomes stronger, and the potential generated by the Hall element 71 becomes higher.

FIG. 17 shows changes of the output value from the Hall element 71 of the cartridge 40 of the second embodiment in a process in which the cartridge 40 is mounted onto the printer 1. In FIG. 17, the horizontal axis indicates time, and the vertical axis indicates the output value from the Hall element 71. Time 0 is a time point at which the cartridge 40 is mounted at the predetermined position in the space C.

Before the cartridge 40 is mounted at the predetermined position in the space C (when the cartridge is not mounted at the predetermined position in the space C), the output value from the Hall element 71 is kept at a ground potential (0V) (see the "Cartridge not mounted" range shown in FIG. 17). The output value from the Hall element 71 increases from the ground potential to V1 when the cartridge 40 is mounted at the predetermined position in the space C and electrical connections between the terminals 170*c* through 177*c* and terminals 170*p* through 177*p* are achieved. After that, the output value from the Hall element 71 increases gradually from V1 to Vh in a process in which the valve 60 moves from the closed position to the open position. While the cartridge 40 is mounted at the predetermined position in the space C, the output value V from the Hall element 71 is higher than the ground potential and lower than the power-source potential (Vmax) ($0<Vmin<V1\leq V\leq Vh<Vmax$) regardless of the position of the valve 60 (see the "Cartridge mounted" range shown in FIG. 17).

If the output value V from the Hall element 71 is higher than or equal to Vmin and lower than Vmax ($Vmin\leq V<Vmax$), the controller 100 determines that the cartridge 40 is mounted at the predetermined position in the space C (S1: YES). If the output value V from the Hall element 71 is lower than Vmin ($V<Vmin$), the controller 100 determines that the cartridge 40 is not mounted at the predetermined position in the space C (S1: NO).

In S9 of FIG. 11, if the output value from the Hall element 71 is lower than or equal to the threshold value Vt, the controller 100 determines that the valve 60 is at the closed position (S9: NO). If the output value from the Hall element 71 exceeds the threshold value Vt, the controller 100 determines that the valve 60 is at the open position (S9: YES).

Next, the third embodiment of the invention will be described while referring to FIGS. 18A and 18B. The third embodiment has substantially the same configuration as the first embodiment, except that the magnet 72 is omitted and that the valve main body 62 of the valve 60 is made of a magnet that generates a magnetic field, not a magnetic body.

Figure 18A:
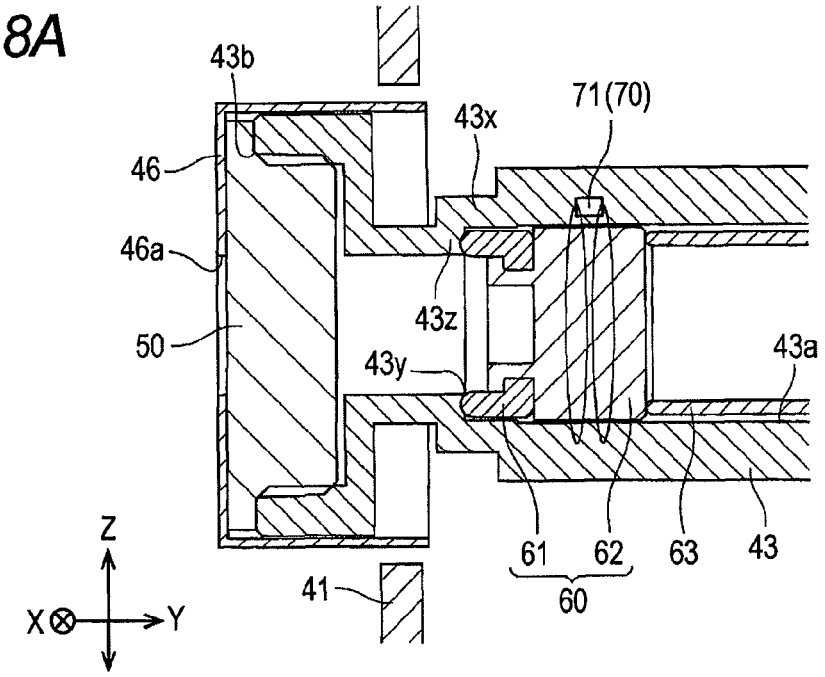
FIGS. 18A and 18B are partial cross-sectional views showing a cartridge according to a third embodiment of the invention, and show states in a closed position and in an open position, respectively.

In the third embodiment, when the valve 60 is at the closed position as shown in FIG. 18A, the valve main body 62 (a magnetic-field generating member and a movable member) is directly below the Hall element 71, and the magnetic field generated by the valve main body 62 reaches the Hall element 71. In other words, the Hall element 71 is disposed in the magnetic field formed by the valve main body 62 (a magnetic-field forming section). In this state, the magnetic field detected by the Hall element 71 is strong, and the Hall element 71 generates a high potential.

Figure 18B:
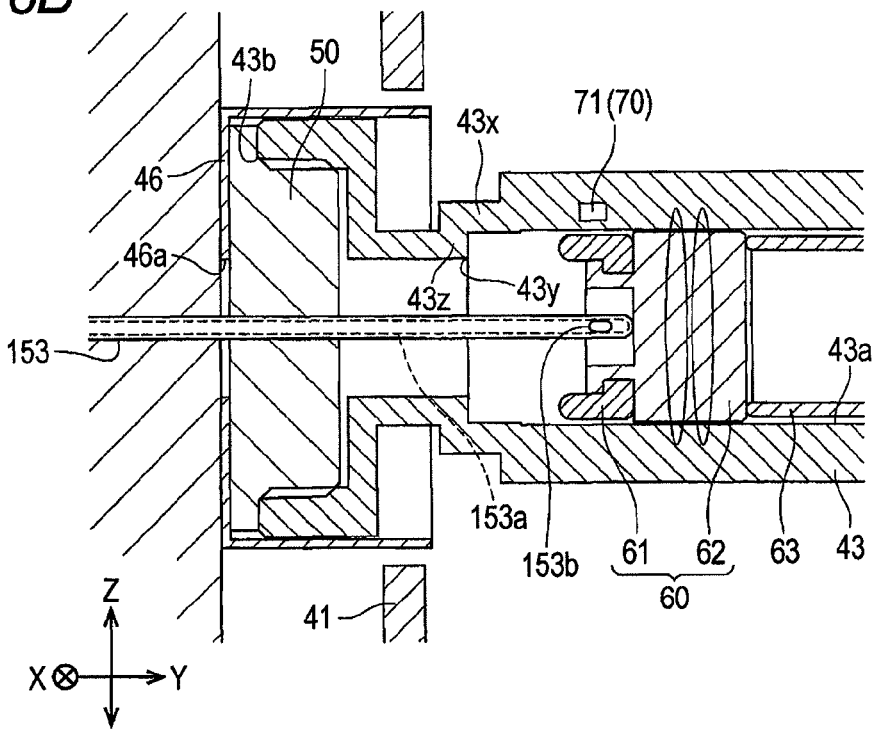

When the valve 60 moves from the closed position shown in FIG. 18A to the open position shown in FIG. 18B, as the valve main body 62 separates from the Hall element 71, the magnetic field detected by the Hall element 71 becomes weaker and the potential generated by the Hall element 71 becomes lower.

The changes in the output value from the Hall element 71 in the third embodiment are similar to those in the first embodiment (FIGS. 14A and 14B). In the present embodiment, because the valve main body 62 serves as the magnetic-field generating member and the movable member, reliability in mounting determination can be improved with a simple configuration.

Next, the fourth embodiment of the invention will be described while referring to FIGS. 19A and 19B. The fourth embodiment has substantially the same configuration as the first embodiment, except that the valve 60 is omitted, that the hollow needle 153 is made of a magnetic body, and that the process S9 in FIG. 11 is different.

Figure 19A:
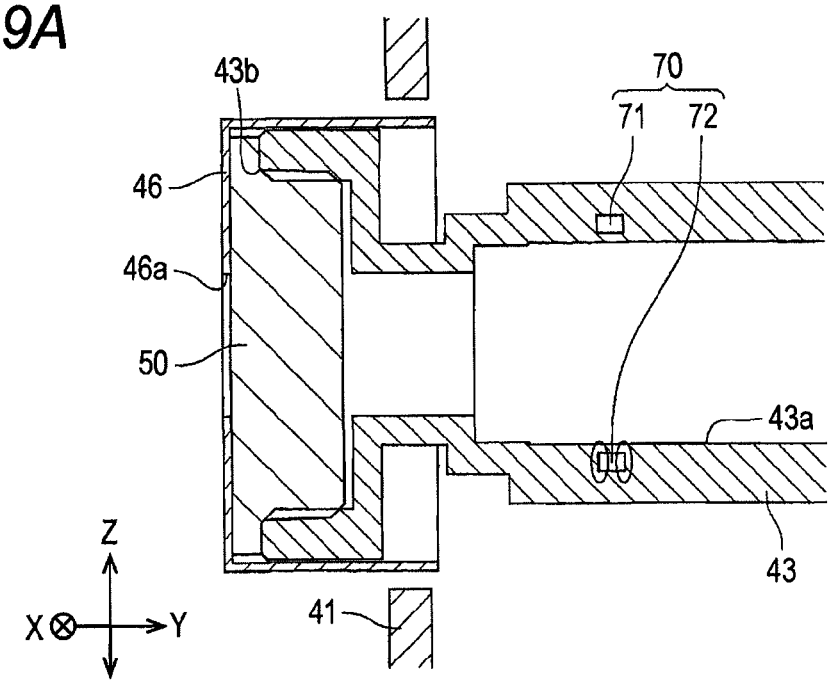

As shown in FIG. 19A, when the hollow needle 153 is not inserted in the supply channel 43*a*, the magnet 72 (the magnetic-field generating member) does not confront the hollow needle 153 (the movable member) in the vertical direction Z. That is, the hollow needle 153 is located at a position not between the Hall element 71 and the magnet 72. At this time, the magnetic field detected by the Hall element 71 is weak, and the Hall element 71 generates a low potential.

Figure 19B:
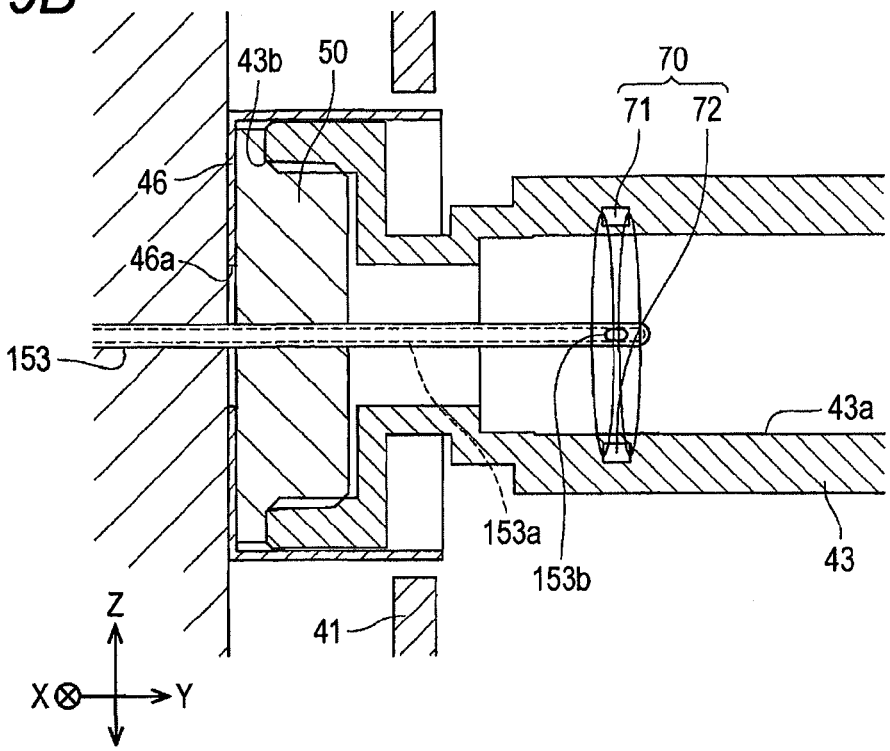

As shown in FIG. 19B, when the hollow needle 153 penetrates the plug 50 and is inserted into the supply channel 43*a*, the hollow needle 153 is disposed at a position confronting the Hall element 71 and the magnet 72 in the vertical direction Z (that is, a position between the Hall element 71 and the magnet 72). With this movement, the magnetic field generated by the magnet 72 reaches the Hall element 71 efficiently via the hollow needle 153. At this time, the Hall element 71 is disposed in the magnetic field formed by the magnet 72 and the hollow needle 153 (cooperate to serve as the magnetic-field forming section). Accordingly, the magnetic field detected by the Hall element 71 becomes stronger, and the potential generated by the Hall element 71 becomes higher.

The changes in the output value from the Hall element 71 in the fourth embodiment are similar to those in the second embodiment (FIG. 17).

In S9 of FIG. 11, the controller 100 determines whether the hollow needle 153 is inserted in the supply channel 43*a*, not whether the valve 60 is located at the open position. Similar to the second embodiment, if the output value from the Hall element 71 is lower than or equal to the threshold value Vt, the controller 100 determines that the hollow needle 153 is not inserted in the supply channel 43*a* (S9: NO). If the output value from the Hall element 71 exceeds the threshold value Vt, the controller 100 determines that the hollow needle 153 is inserted in the supply channel 43*a* (S9: YES). Accordingly, in the fourth embodiment, "Valve closed" and "Valve open" in FIG. 17 should be read as "Hollow needle not inserted" and "Hollow needle inserted", respectively.

Further, in the fourth embodiment, the position determining section M12 determines the position of the hollow needle 153, based on the output value from the Hall element 71.

According to the fourth embodiment, the valve is not provided at the cartridge, and insertion of the hollow needle 153 can be detected with a simple configuration of the magnet 72 and the Hall element 71. Further, the open position and the closed position can be switched with a simple configuration of linear movement (insertion and removal) of the hollow needle 153.

With the above-described second through fourth embodiments, effects similar to those of the first embodiment (the effect that reliability in mounting determination can be secured while suppressing a cost increase of the cartridge, and the like) can be obtained.

Next, the fifth embodiment of the invention will be described while referring to FIGS. 20 through 22A and 22B. In the cartridge 40 of the present embodiment, a photo sensor (optical sensor) is used instead of a magnetic sensor.

Figure 20:
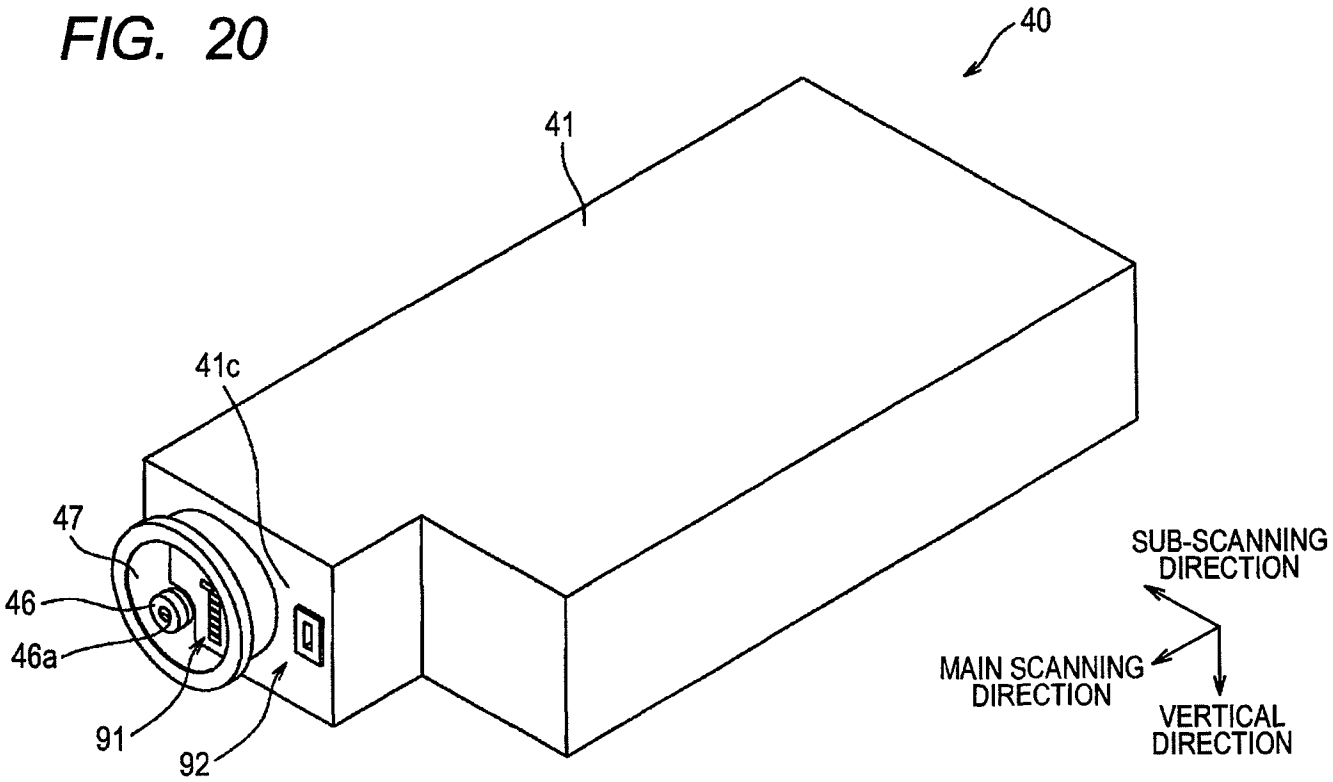
FIG. 20 is a perspective view of an ink cartridge according to a fifth embodiment of the invention.
Figure 21:
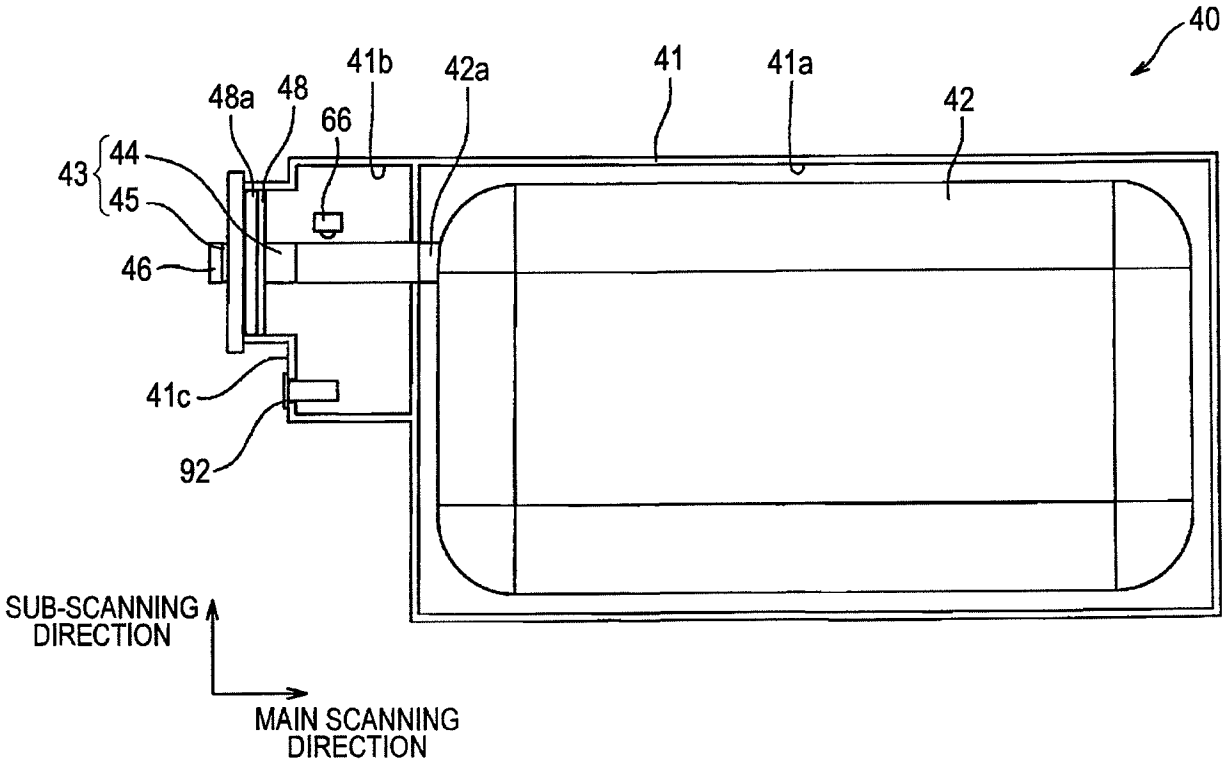
FIG. 21 is a diagram showing the internal structure of the ink cartridge according to the fifth embodiment.
Figure 22A:
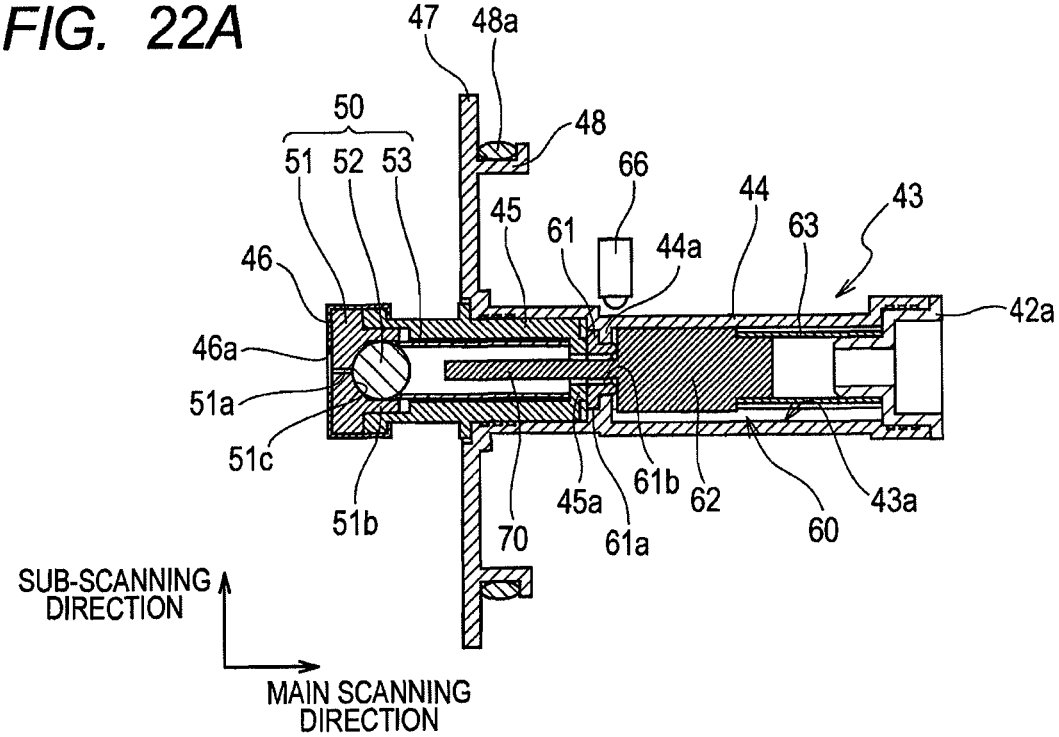
Figure 22B:
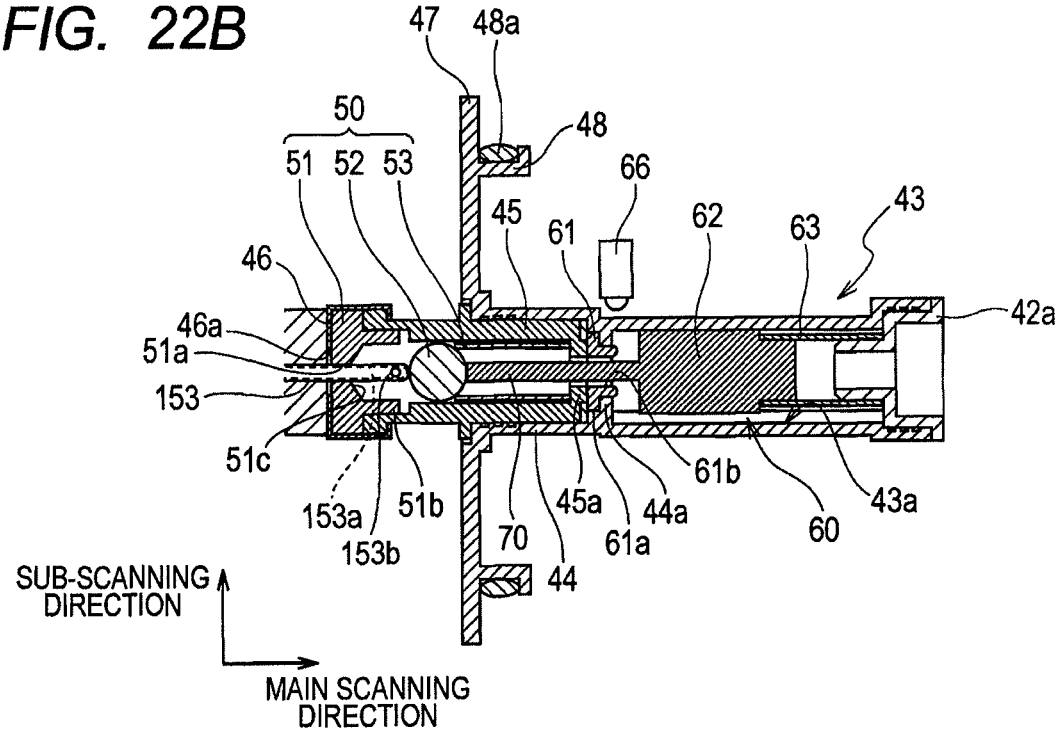

As shown in FIGS. 20 and 21, the cartridge 40 has a housing 41 of substantially a rectangular parallelepiped shape, an ink pouch (ink accommodating section) 42 disposed in the housing 41 and filled with ink therein, an ink leading pipe 43 in fluid communication with the ink pouch 42 at one end thereof, a first valve 50, and a second valve 60 (see FIGS. 22A and 22B).

As shown in FIG. 21, the housing 41 is defined such that two chambers 41*a* and 41*b* are formed therein. The ink pouch 42 is disposed in the chamber 41*a* at the right side. On the other hand, the ink leading pipe 43 is disposed in the chamber 41*b* at the other side.

As shown in FIGS. 21, 22A, and 22B, the ink leading pipe 43 has a pipe 44 connected with a connection section 42*a* provided at the ink pouch 42, and a pipe 45 fitted to one side (the left side) of the pipe 44. The ink leading pipe 43 is formed with an ink channel 43*a* extending in the main scanning direction and being in fluid communication with the ink pouch 42. The both pipes 44 and 45 of the present embodiment are made of transparent resin. Because the pipe 45 is made of transparent resin, a photo sensor 66 described later is capable of detecting a valve member 62.

As shown in FIGS. 22A and 22B, an annular flange 47 is formed at one end of the pipe 44. As shown in FIGS. 21, 22A, and 22B, an annular protrusion 48 having an O-ring 48*a* is formed at the flange 47. Thus, as shown in FIG. 21, the O-ring 48*a* seals between the housing 41 and the annular protrusion 48. Note that the flange 47 is a part of the wall of the chamber 41*b*, and constitutes a part of the housing 41.

As shown in FIG. 20, a contact 91 is formed on the outer surface of the flange 47. The contact 91 is disposed to be juxtaposed to an ink discharge port 46*a* described later in the sub-scanning direction. The contact 91 is electrically connected with the photo sensor 66 described later.

A power input section 92 is provided at the side surface of the housing 41 at the ink discharge port 46*a* side. A stepped surface 41*c* is provided between the ink discharge port 46*a* and the power input section 92 of the housing 41, the stepped surface 41*c* being concaved from the flange 47 toward the ink pouch 42 in the main scanning direction. The power input section 92 is disposed on the stepped surface 41*c*. The power input section 92 is electrically connected with the photo sensor 66. The power input section 92 supplies the photo sensor 66 with electric power by being electrically connected with a power output section (not shown) of the printer main body.

As shown in FIGS. 22A and 22B, the first valve 50 is disposed in the pipe 45 of the ink leading pipe 43. The first valve 50 has a sealing body (elastic body) 51 that seals an opening (outlet of ink) formed at one end (the left end) of the pipe 45, a spherical body 52, and a coil spring 53. A lid 46 is provided at one end of the pipe 45, so that the sealing body 51 does not come off from the pipe 45. An ink discharge port 46*a* is formed in the lid 46.

One end of the coil spring 53 is in contact with the spherical body 52, and the other end of the coil spring 53 is in contact with a stepped portion 45*a* formed at the other end of the pipe 45, and the coil spring 53 constantly urges the spherical body 52 toward the sealing body 51. In the present embodiment, the coil spring 53 is adopted as an urging member. However, an urging member other than the coil spring may be adopted as long as the spherical body 52 can be urged toward the sealing body 51.

The sealing body 51 is made of elastic material such as rubber. Further, the sealing body 51 is formed with a slit (penetrating hole) 51*a*, an annular protrusion 51*b*, and a curved portion 51*c*. The slit (penetrating hole) 51*a* penetrates the center of the sealing body 51 in the main scanning direction. The annular protrusion 51*b* can be fitted to one end of the pipe 45. The curved portion 51*c* is a surface confronting the spherical body 52 and formed along the outer circumferential surface of the spherical body 52 in a part surrounded by the annular protrusion 51*b*. The diameter of the slit 51*a* is smaller than a hollow needle 153 described later. Hence, when the hollow needle 153 is inserted in the slit 51*a*, the sealing body 51 elastically deforms such that the inner circumferential surface of the slit 51*a* makes close contact with the outer circumferential surface of the hollow needle 153, so ink does not leak from between the slit 51*a* and the hollow needle 153.

The inner diameter of the annular protrusion 51*b* is slightly smaller than the diameter of the spherical body 52, and the slit 51*a* is sealed due to contact with the spherical body 52. Note that the slit 51*a* is also sealed due to contact between the curved portion 51*c* and the spherical body 52.

In this configuration, as shown in FIG. 22B, when the hollow needle 153 is inserted into the slit 51*a* through the ink discharge port 46*a*, the distal end of the hollow needle 153 abuts the spherical body 52, and the spherical body 52 moves to separate from the curved portion 51*c* and the annular protrusion 51*b*. At this time, the first valve 50 changes from the closed state to the open state. When the first valve 50 is in the open state, because the hole 153*b* of the hollow needle 153 has passed the slit 51*a*, the hollow needle 153 is communicated with the ink channel 43*a*. On the other hand, as the hollow needle 153 moves in a direction of pulling out of the slit 51*a*, the spherical body 52 moves in a direction of approaching the annular protrusion 51*b* due to urging of the coil spring 53. Then, when the spherical body 52 makes contact with the annular protrusion 51*b*, the first valve 50 changes from the open state to the closed state. Further, as the hollow needle 153 moves in the direction of pulling out, the spherical body 52 makes close contact with the curved portion 51*c*. In this way, the first valve 50 takes one of the open state for allowing fluid communication of the ink leading pipe 43, and the closed state for blocking fluid communication of the ink leading pipe 43, depending on insertion and removal of the hollow needle 153.

As shown in FIGS. 22A and 22B, the second valve 60 has a valve seat 61, a valve member 62, and a coil spring 63. The valve seat 61 is made of elastic material such as rubber, and is disposed such that its flange 61*a* is interposed between an annular protrusion 44*a* and a stepped portion 45*a*, the annular protrusion 44*a* protruding from the inner circumferential surface around the center of the pipe 44. In the center of the valve seat 61, a hole (opening) 61*b* is formed to penetrate in the main scanning direction, and the pipe 44 can be communicated with the pipe 45.

One end of the coil spring 63 is in contact with the valve member 62, and the other end of the coil spring 63 is in contact with a connection section 42*a*, and the coil spring 63 constantly urges the valve member 62 toward the valve seat 61. In other words, the coil spring 63 urges the valve member 62 in a direction toward the sealing body 51, and the valve member 62 makes contact with the right end portion of the valve seat 61 (opening edge of the hole 61*b*), thereby blocking fluid communication of the ink channel 43*a*. That is, fluid communication between the pipe 44 and the pipe 45 is blocked, and the second valve 60 becomes the closed state. At this time, the right end portion of the valve seat 61 is elastically deformed due to the urging force of the coil spring 63. Further, the coil spring 63 urges the valve member 62 toward the sealing body 51, and the elements constituting the first and second valves 50 and 60 are aligned on a straight line along the main scanning direction. Hence, the first and second valves 50 and 60 can be opened and closed by insertion/removal of the hollow needle 153 described later into/from the sealing body 51. In addition, the second valve 60 can be constituted from a simple configuration, so that failures of the second valve 60 can be reduced.

The valve member 62 has a cylindrical shape, and is slidable on the inner circumferential surface of the pipe 44. Further, the end surface of the valve member 62 at the connection section 42*a* side has a convex shape that its center protrudes in the main scanning direction. And, by fitting the coil spring 63 to this protruding portion of the valve member 62, the coil spring 63 is fixed to the valve member 62.

A pushing member 70 is disposed in the ink leading pipe 43. When the hollow pipe 153 is inserted, the pushing member 70 pushes and moves the valve member 62 in a direction opposite the urging direction of the coil spring 63. The pushing member 70 is a cylindrical bar-shaped member extending in the main scanning direction, and is formed integrally at the end portion of the valve member 62 at the valve seat 61 side. In other words, the valve member 62 and the pushing member 70 constitute a movable member. The pushing member 70 has a diameter smaller than the diameter of the hole 61*b*, and is disposed to extend through the hole 61*b*. The pushing member 70 has such a length that, in a state where the valve member 62 is in contact with the valve seat 61 (the second valve 60 is in the closed state), a gap is formed between the distal end of the pushing member 70 and the spherical body 52 located at a position when the first valve 50 changes from the open state to the closed state (when the spherical body 52 makes contact with the annular protrusion 51*b* from a state separated from the sealing body 51).

In this configuration, as shown in FIG. 22B, after the hollow needle 153 is inserted and the first valve 50 becomes the open state, the spherical body 52 makes contact with the distal end of the pushing member 70. And, as the hollow needle 153 is further inserted, the pushing member 70 and the valve member 62 move to separate the valve member 62 from the valve seat 61. With this operation, the second valve 60 changes from the closed state to the open state. At this time, because the pipes 44 and 45 of the ink channel 43*a* are communicated with each other, ink in the ink pouch 42 flows into the hollow needle 153. On the other hand, when the hollow needle 153 is removed, in a similar manner to the first valve 50, the valve member 62 and the pushing member 70 move due to urging of the coil spring 63, and the valve member 62 makes close contact with the valve seat 61. With this operation, the second valve 60 changes from the open state to the closed state. In this way, the second valve 60 also takes one of the open state for allowing fluid communication of the ink channel 43*a* of the ink leading pipe 43, and the closed state for blocking the fluid communication, depending on insertion and removal of the hollow needle 153.

The photo sensor 66 connected with the contact 91 is provided in the chamber 41*b* of the housing 41. The photo sensor 66 is a reflection-type optical sensor that is capable of detecting an existence of an object in a non-contact state. The photo sensor 66 is disposed at a position confronting the downstream end of the valve member 62 when fluid communication of the ink channel 43*a* is blocked by the second valve 60 as shown in FIG. 22A, and at a position not confronting the valve member 62 when fluid communication of the ink channel 43*a* is not blocked by the second valve 60 as shown in FIG. 22B.

As the photo sensor 66, for example, a reflection-type optical sensor having a light emitting portion and a light receiving portion may be adopted. In this case, a mirror surface capable of reflecting light is formed on at least part of the valve member 62 (the movable member). In the present embodiment, the light emitting portion and the mirror surface of the valve member 62 serve as the optical-field forming section.

When the photo sensor 66 confronts the valve member 62 (the closed state), light emitted from the light emitting portion is reflected by the mirror surface of the valve member 62, and this reflection light is received by the light receiving portion. At this time, the photo sensor 66 outputs a high output value indicating that the light receiving portion receives light (corresponding to Vh in FIGS. 14A and 14B).

On the other hand, when the photo sensor 66 does not confront the valve member 62 (the open state), light emitted from the light emitting portion is not reflected by the mirror surface of the valve member 62, and the light receiving portion does not receive light. At this time, the photo sensor 66 outputs a low output value indicating that the light receiving portion does not receive light (corresponding to V1 in FIGS. 14A and 14B).

These output values are transmitted to the controller of the printer via the contact 91. By receiving these signals, the controller can detect the open state and the closed state of the second valve 60 in a distinguishable manner.

Similar to the above-described embodiments, the controller determines that the second valve 60 is at the open position if the output value from the photo sensor 66 is lower than or equal to the threshold value Vt (for example, $Vt=(Vh+V1)/2$) ($V \leq Vt$), and determines that the second valve 60 is at the closed position if the output value from the photo sensor 66 exceeds the threshold value Vt ($Vt<V$).

Like the Hall element shown in FIG. 14B does, the photo sensor 66 of the present embodiment generates a potential higher than a ground potential ($V=Vmin>0$) when the photo sensor 66 is disposed in an optical field of magnitude 0 (that is, when the light receiving portion receives no light at all).

According to the above-described configuration, even if the cartridge 40 is mounted at the predetermined position of the printer while the second valve 60 is at the open position, the photo sensor 66 does not output a potential that is the same as the ground potential (a potential inputted to the controller when the cartridge 40 is not mounted at the predetermined position). Accordingly, the controller does not determine that the cartridge 40 is not mounted at the predetermined position despite a fact that the cartridge 40 is mounted at the predetermined position. Accordingly, in the present embodiment, too, an error in mounting determination can be suppressed, and reliability in mounting determination can be secured.

Note that the photo sensor 66 is not limited to the reflection-type optical sensor and, for example, a transmission-type optical sensor may be used.

While the liquid cartridge and the liquid ejecting apparatus of the invention have been described in detail with reference to the above embodiments thereof, various changes and modifications may be made therein without departing from the scope of the claims.

For example, in the above-described first through fourth embodiments, the movable member and the magnetic-field forming section (the magnetic-field generating member, the magnetic body) have configurations in respective patterns, but may have configurations in different patterns. For example, in the fourth embodiment, a pattern can be conceived that the hollow needle 153 is made of the magnetic-field generating member (magnet) and that the magnet 72 is omitted.

<Terminals of Cartridge>

The terminals may be provided separately on a plurality of boards. Further, the power-source terminal, the ground terminal, and the output terminal need not be arranged on the same plane.

The shapes of the terminals are not limited to rectangular shapes but may be any shape such as circular shape, for example. Further, distances between the terminals need not be equal.

The surface on which the terminals are arranged need not be the surface perpendicular to the mounting direction of the cartridge to the mounting section, and may be a surface parallel to the mounting direction, for example.

The number of the sensor-signal output terminal(s) may be changed in accordance with the number of the magnetic sensor(s). Further, the number of the ground terminal(s) may be an arbitrary number that is larger than or equal to one.

The power-source terminal may be electrically connected only with the magnetic sensor, so as to input a power-source potential only to the magnetic sensor. For example, the power-source potential may be inputted to the memory 141 (storage section) via a data input terminal.

Further, the number of the power-source terminal(s) may be an arbitrary number that is larger than or equal to one. For example, an individual power-source terminal may be provided for each of a plurality of magnetic sensors.

The arrangement, the sizes of the terminals, and distances between the terminals may be changed arbitrarily. For example, in FIG. 7, the positions of the data input terminal 173*c* and the data output terminal 172*c* may be switched. The positions of the sensor-signal output terminals 170*c* and 171*c* may be switched. The power-source terminal 174*c* may be arranged at the right-lower end, the left-upper end, the left-lower end, or the like, not the right-upper end, or may be arranged at a position other than an end of a row. Further, the number of row(s) in which terminals are arranged, the number of terminal(s) included in each row, and the like are also arbitrary. Additionally, terminals may be arranged in a circular shape, or in a random shape, not in rows.

The storage section may be omitted, and the terminal for the storage section may be omitted.

<Terminal of Apparatus Main Body>

The terminal of the apparatus main body may have the same size as or a larger size than the terminal of the cartridge.

The number or arrangement of the terminal(s) of the apparatus main body may partially correspond to the terminals of the cartridge. For example, in a case where the terminals of the cartridge are arranged in two rows each including three terminals, the terminals of the apparatus main body may be arranged in two rows each including four terminals. In this case, the terminals of the apparatus main body include terminals that do not contact the terminals of the cartridge. Similarly, the number or arrangement of the terminal(s) of the cartridge may partially correspond to the terminals of the apparatus main body. The terminals of the cartridge may include terminals that do not contact the terminals of the apparatus main body.

The terminals of the apparatus main body may be terminals of a leaf-spring type (terminals urged by leaf springs in a direction toward the terminals of the cartridge) or may be other than a leaf-spring type. Further, the terminals of the apparatus main body and the terminals of the cartridge may be so designed that positions other than centers of the terminals serve as contact portions.

The movable member that moves in the channel is not limited to a valve that opens/closes the channel, and may be a valve that adjusts a flow amount in the channel or other arbitrary members.

<Magnetic Sensor>

The number of the magnetic sensor(s) provided at the cartridge may be an arbitrary number that is larger than or equal to one.

In the above-described embodiments, the magnetic sensor (Hall element 71) is used that generates a potential higher than a ground potential when disposed in a magnetic field of magnitude 0. However, a magnetic sensor may be used that generates a potential that is the same as the ground potential when disposed in a magnetic field of magnitude 0.

In the above-described embodiments, the magnetic sensor (Hall element 71) is used that generates a potential lower than a power-source potential when the cartridge is mounted on the mounting section. However, a magnetic sensor may be used that generates a potential that is the same as the power-source potential when the cartridge is mounted on the mounting section.

The arrangement of the magnetic sensor and the magnetic-field generating member may be changed appropriately. For example, the magnetic sensor may be disposed at an arbitrary and appropriate position in a magnetic field that is generated by the magnetic-field generating member and the movable member (the hollow member in the fourth embodiment).

<Other Configuration of Cartridge>

The ground potential is not limited to 0V, as long as it is lower than the power-source potential.

In the above-described embodiments, the cartridge individually stores two kinds of liquid (black ink and pre-coat liquid). However, the cartridge may store only one kind of liquid.

Data stored in the storage section are not limited to particular kinds of data. As data relating potential generated by the magnetic sensor, the amount of liquid within the liquid storing section, and the like, the storage section need not store the potential and the amount of liquid within the liquid storing section themselves. Instead, the storage section may store data from which the potential and the amount of liquid can be derived.

The storage section need not store sensor output values. The sensor output values are data (Vh, V1) that serve as criterion for judgment of the position of the movable member (the valve main body 62 in the first through third embodiments, the hollow needle 153 in the fourth embodiment). In this case, for example, the sensor output values may be stored in the ROM of the apparatus main body, and the position determining section may determine the position based on the output values from the magnetic sensor and on data (Vh, V1) read out from the ROM.

In addition, without departing from the scope of the claims, the configurations (shapes, positions, etc.) of each part (the housing 41, the reservoir 42, the supply pipe 43, the plug 50, the valve 60, the sensor unit 70, the memory 141, the board 142, etc.) of the cartridge may be changed appropriately. Further, other parts may be added, and some parts may be omitted.

<Controls Performed by Apparatus Main Body>

Regarding determination by the mount determining section, in the above-described embodiments, it is determined that the cartridge is mounted on the mounting section when the potential V is Vmin≤V<Vmax (see FIGS. 14A, 14B, and 17). However, the range is not limited to the above range as long as the potential is higher than a ground potential. For example, it may be determined that the cartridge is not mounted on the mounting section in the case of V=ground potential, and it may be determined that the cartridge is mounted on the mounting section in the case of V>ground potential.

Regarding determination by the position determining section, in the above-described embodiments, Vh and V1 are used as the potentials serving as criterion for judgment of the position of the movable member, but other values may be used. For example, without using data unique to the cartridge such as Vh and V1, the position may be determined by using Vmax and Vmin stored in the ROM of the apparatus main body, for example, based on the threshold value Vt=(Vmax+Vmin)/2. The calculation method of the threshold value Vt is also arbitrary. Further, the threshold value Vt itself, not Vh and V1 etc., may be stored in the storage section of the cartridge or in the ROM of the apparatus main body.

The apparatus main body may stop an operation of each section of the apparatus main body (an ejecting operation of the head, etc.), without reporting an error.

Timing at which transmission and reception of signals are allowed between the cartridge and the apparatus main body and timing at which power supply is allowed from the apparatus main body to the cartridge are not limited to those described above. The timings can be changed arbitrarily.

Writing of data by the writing section and determination of abnormality by the abnormal-writing determining section may also be performed prior to reception of a print command from an external device.

Timing at which each functioning section performs a function, such as timing at which the reading section reads data stored in the storage section of the cartridge, timing at which the writing section writes data in the storage section of the cartridge, timing at which the receiving section receives a signal from the magnetic sensor, timing at which the abnormal-writing determining section determines abnormal writing, timing at which the abnormal-reception determining section determines abnormal reception, timing at which the moving section moves the hollow member, and the like may be changed appropriately.

The hollow member may have a tip that is not acicular like a needle.

Liquid stored in the liquid cartridge is not limited to ink and pre-coat liquid. For example, the liquid may be post-coat liquid that is ejected onto a recording medium subsequent to recording in order to improve image quality, cleaning liquid for cleaning the conveying belt, and the like.

The number of the cartridge(s) included in a liquid ejecting apparatus may be an arbitrary number larger than or equal to one.

The number of the liquid ejecting head(s) included in a liquid ejecting apparatus is not limited to two, but may be an arbitrary number larger than or equal to one. For example, the liquid ejecting apparatus may be a color inkjet printer including heads that eject black ink and ink in three colors (magenta, cyan, and yellow).

The liquid ejecting apparatus may be a line type or a serial type. Further, the liquid ejecting apparatus is not limited to a printer, but may be any liquid ejecting apparatus such as a facsimile apparatus, a copier, and the like.

What is claimed is:

1. A liquid cartridge comprising:

a liquid storing section defining a liquid storing chamber that stores liquid;

a channel section defining a channel in fluid communication with the liquid storing chamber;

a magnetic-field generating member provided at the channel section and configured to generate a magnetic field;

a magnetic sensor provided at the channel section and facing the magnetic-field generating member with the channel interposed therebetween;

a power-source terminal configured such that a power-source potential is inputted thereto, the magnetic sensor being electrically connected with the power-source terminal;

a ground terminal configured such that a ground potential is inputted thereto, the magnetic sensor being electrically connected with the ground terminal; and an output terminal electrically connected with the magnetic sensor and configured to output a potential generated by the magnetic sensor, wherein the magnetic sensor is configured to generate a potential that changes depending on change of the magnetic field, the potential being higher than the ground potential regardless of the change of the magnetic field.

2. The liquid cartridge according to claim 1, wherein the magnetic sensor is configured to generate a potential higher than the ground potential when the magnetic sensor is disposed in a magnetic field of magnitude of zero.

3. The liquid cartridge according to claim 1, wherein the magnetic sensor is configured to generate a potential lower than the power-source potential regardless of changes of the magnetic field.

4. The liquid cartridge according to claim 1, wherein the magnetic field generated by the magnetic-field generating member changes depending on a position of a magnetic hollow member inserted in the channel from outside of the liquid cartridge; and wherein, when the hollow member is positioned between the magnetic-field generating member and the magnetic sensor, the magnetic sensor is configured to generate a potential that is higher than a potential generated when the hollow member is not positioned between the magnetic-field generating member and the magnetic sensor.

* * * * *